US006846227B2

(12) United States Patent
Sato et al.

(10) Patent No.: US 6,846,227 B2
(45) Date of Patent: Jan. 25, 2005

(54) ELECTRO-CHEMICAL MACHINING APPARTUS

(75) Inventors: Shuzo Sato, Kanagawa (JP); Zenya Yasuda, Kanagawa (JP); Masao Ishihara, Tokyo (JP); Hiizu Ootorii, Kanagawa (JP); Takeshi Nogami, Kanagawa (JP); Naoki Komai, Kanagawa (JP)

(73) Assignee: Sony Corporation, Tokyo (JP)

( * ) Notice: Subject to any disclaimer, the term of this patent is extended or adjusted under 35 U.S.C. 154(b) by 192 days.

(21) Appl. No.: 10/085,747

(22) Filed: Feb. 28, 2002

(65) Prior Publication Data

US 2002/0160698 A1 Oct. 31, 2002

(30) Foreign Application Priority Data

Feb. 28, 2001 (JP) ..... P2001-056027

(51) Int. Cl.[7] ..... B24B 29/00

(52) U.S. Cl. ..... 451/288; 451/41; 451/53; 451/60; 451/908

(58) Field of Search ..... 216/88, 89, 90; 438/692, 693; 451/5, 7, 14, 36, 41, 53, 59, 60, 63, 285, 286, 287, 288, 289, 290, 908

(56) References Cited

U.S. PATENT DOCUMENTS 5,624,300 A * 4/1997 Kishii et al. ..... 451/36
5,911,619 A * 6/1999 Uzoh et al. ..... 451/5
5,922,620 A * 7/1999 Shimomura et al. ..... 438/693
6,074,284 A * 6/2000 Tani et al. ..... 451/57
6,176,992 B1 * 1/2001 Talieh ..... 205/87
6,217,423 B1 * 4/2001 Ohmori et al. ..... 451/63
6,368,190 B1 * 4/2002 Easter et al. ..... 451/41
6,413,403 B1 * 7/2002 Lindquist et al. ..... 205/97
6,464,855 B1 * 10/2002 Chadda et al. ..... 205/662
6,558,231 B1 * 5/2003 Taylor ..... 451/36
6,582,281 B2 * 6/2003 Doan et al. ..... 451/41
2002/0151257 A1 * 10/2002 Basol et al. ..... 451/41

FOREIGN PATENT DOCUMENTS

JP 363013105 A * 1/1988

* cited by examiner

*Primary Examiner*—Timothy V. Eley
(74) *Attorney, Agent, or Firm*—Sonnenschein, Nath & Rosenthal LLP

(57) ABSTRACT

The electro-chemical machining apparatus of this invention is designed to smoothing a metal film by efficiently reducing initial rough surface and removing excessive metal film with reduced damages to the metal film. For this end, the electro-chemical machining apparatus performs electro-chemical machining of an object to be machined having a metal film on the surface to be machined. Such apparatus has a means for holding the object to be machined, a wiper for wiping the surface of the object to be machined, a means for supplying electrolytic solution onto the surface of the object to be machined, a first electrode disposed at a position opposed to the surface of the object to be machined, a second electrode disposed at a peripheral portion on the surface of the object to be machined, and a power supply for causing electrical current to flow between the second electrode on the surface of the object to be machined and the first electrode.

20 Claims, 28 Drawing Sheets

ELECTRO-CHEMICAL MACHINING APPARTUS

CROSS REFERENCE TO RELATED APPLICATIONS

This application claims priority to Japanese Patent Application No. JP 2001-056027, filed on Feb. 28, 2001, and the disclosure of such application is herein incorporated by reference to the extent permitted by law.

BACKGROUND OF THE INVENTION

1. Field of the Invention

The present invention is related to an electro-chemical machining apparatus, more specifically to an electro-chemical machining apparatus for smoothing a rough surface on a metal film forming process.

2. Related Art

High scale integration and miniaturization of semiconductor devices have accelerated the introduction of narrower, fine pitch and multilayered wirings, thus increasing the significance of multilayer wiring techniques in semiconductor fabrication processes.

Although it has been conventional to use aluminum as wiring material in multilayer semiconductor devices, many attempts have been made to develop new wiring processes replacing aluminum with copper as the wiring material so as to reduce signal propagation delay in recent 0.25 $\mu$m or less design rules. The use of copper is advantageous in that it permits achieving both low electric resistance and high endurance to electro migration.

As far as copper wiring process is concerned, it is typical to use the so-called damascene process in which metal is buried in a groove wiring pattern, e.g., formed in advance in an interlayer insulation film. Then, a chemical mechanical polishing (CMP) process is applied to form the wiring by removing excessive metal film. The damascene process is advantageous in that no etching of the wiring is required and the interlayer insulation film to be formed thereon is essentially flat, thereby simplifying the process. Also, significant reduction in wiring process is achieved by the dual damascene process in which not only the wiring grooves but also contact holes are formed in the interlayer insulation film for simultaneously burying metal in the wiring grooves and the contact holes.

In addition, one example of copper wiring process according to the above-mentioned dual damascene process will be described with reference to the accompanying drawings.

Firstly, as illustrated in FIG. 34, an interlayer insulating film 302 made of silicon oxide, for example, is formed by, e.g., low pressure chemical vapor deposition (CVD) on a semiconductor substrate 301 made of, for example, silicon having impurity diffused regions (not shown in the drawing) selectively formed thereon.

Next, as illustrated in FIG. 35, contact holes (CH) leading to the impurity diffused regions of the semiconductor substrate 301 and grooves (M) of a designated wiring pattern making electrical connection to the impurity diffused regions are formed using conventional photolithography and etching techniques.

FIG. 36 illustrates a next step in which a barrier film 305 is provided on the interlayer insulating film 302 as well as in the contact holes (CH) and the wiring grooves (M). The barrier film 305 is made from such materials, e.g., Ta, Ti, TaN, TiN, etc. using a conventional sputtering technique. In the case where copper is used as the wiring material and silicon oxide is used as the interlayer insulation film, the barrier layer 305 is provided to prevent copper oxidation as copper exhibits high diffusion coefficient in relation to silicon oxide.

Next, as illustrated in FIG. 37, copper is deposited onto the barrier film 305 to a designated film thickness through a conventional sputtering technique so as to form a seed film 306.

FIG. 38 illustrates a subsequent step to provide a copper film 307 in such a manner that the contact holes (CH) and the wiring grooves (M) are filled with copper by, e.g., electroplating, CVD, sputtering or other techniques.

FIG. 39 illustrates a subsequent step for removing excessive portions of the copper film 307 and the barrier film 305 on the interlayer insulation film 302 by applying the CMP technique, thereby providing a smooth surface.

The above steps provide copper wirings 308 and contacts 309. Then, the aforementioned steps are repeated on the wirings 308 to provide multilayered wirings.

However, the aforementioned copper wiring using the dual damascene process might cause significant damages to the semiconductor substrate because the conventional CMP method for removing excessive copper film 307 and smoothing the surface has a drawback in which the a polishing tool applies pressure onto the copper film. Especially, in the case where an organic insulation film having low mechanical strength and low dielectric constant as the interlayer insulation film, the abovementioned damages are not negligible because it may result in defects such as cracks in the interlayer insulation film or peeling the interlayer insulation film out of the semiconductor substrate.

Also, because of different removing characteristics between the interlayer insulating film 302, the copper film 307 and the barrier film 305, the wirings 308 tend to present problems such as dishing, erosion (thinning), recess, etc.

As shown in FIG. 40, dishing is a phenomenon causing a dimple by excessive removal at a central portion of the wiring, especially in a relatively wide, e.g., wiring of about 100 $\mu$m wide under, e.g., 0.18 $\mu$m design rule. The dishing is one of the primary causes of wiring problems due to insufficient cross section area of the wiring 308 leading to increased wiring electric resistance. Such dishing is most likely to occur when relatively soft copper or aluminum is used as the wiring material.

As shown in FIG. 41, erosion is a phenomenon that causes excessive removal of the area where wiring pattern density is high, e.g., 1.0 $\mu$m wirings being formed in a range of 3000 $\mu$m with density of about 50%. If such erosion occurred, a cross section area of the wiring is reduced in such an amount that might result in problematic wiring electric resistance.

A recess is shown in FIG. 42, in which steps are created at the boundary of the interlayer insulation film 302 and the wirings 308 by lowering the wirings 308. Again, cross section area of the wirings is insufficient in this case and might result in wiring electric resistance defects.

On the other hand, in the surface smoothing and removing steps of the excessive copper film 307 by the CMP process, a polishing rate represented by the amount of removing copper in a predetermined time span is required to be set to, e.g., 500 nm/min or higher in order to efficiently removing the copper film.

In order to increasing the polishing rate, it is necessary to apply higher pressure to the polishing tool onto the wafer. However, increased pressure to the polishing tool may result in scratches (SC) or chemical damages (CD) on the surface of wirings, as shown in FIG. 43. This is most likely to occur in soft copper, thereby causing troubles such as open circuits, short circuits, defective wiring resistance, etc. Also, increased pressure applied onto the polishing tool may result in increased likelihood of the aforementioned scratches, peeling of the interlayer insulation film, dishing, erosion and recess to occur.

SUMMARY OF THE INVENTION

The present invention has been conceived in view of the above mentioned problems associated with the prior art, and it is preferable to provide an electro-chemical machining apparatus capable of smoothing an initial surface roughness or smoothing the surface of a metal film with an improved efficiency in removing excessive metal film and with reduced damages to the metal film.

For this end, an electro-chemical machining apparatus according to a preferred embodiment of the present invention is designed to perform electro-chemical machining an object to be machined having a metal film thereon. Such apparatus includes a holding means for holding the object to be machined; a wiper for wiping the surface of the object to be machined; a means for supplying electrolytic solution onto the surface of the object to be machined; a first electrode disposed in a position opposed to the surface to be machined; a second electrode disposed at a peripheral portion of the surface to be machined; and a power supply for supplying electrical current between the second electrode of the surface to be machined and the first electrode.

According to the electro-chemical machining apparatus of the preferred embodiment of the present invention, in a case in which a metal film is formed on the machining surface of the object to be machined, the electrolytic solution is supplied onto the surface of the object to be machined from the electrolytic solution supplying means and electrical current is caused to flow between the first and second electrodes, thereby anodic oxidizing the metal film surface on the surface of the object to be machined. Such ionization or chelating by reaction with chelating agent makes the metal film weak enough to be wiped off by the wiper. This means that the anode oxidized metal film is easily, efficiently removed with low pressure, thereby eliminating steps on the metal film surface of the object to be machined or smoothing the surface.

Preferably, the metal film to be machined by the electro-chemical machining apparatus is wiring metal film.

Further, it is preferable that the metal film contains copper, aluminum, tungsten, gold or silver or either alloy, oxide or nitride of these metals.

The metal film made from these metallic materials is electrolitically removed to provide a wiring layer.

The holding means for holding the object to be machined of the electro-chemical machining apparatus according to the present invention is preferably designed to rotate the object to be machined about a given center axis.

It is also preferable that the holding means for holding the object to be machined is designed not only holding down but also rotating the object to be machined about a given center axis.

It is preferable that the holding means for holding the object to be machined further includes parallel moving means for moving the object to be machined on the plane parallel to the wiping surface of the wiper.

The surface of the object to be machined is uniformly machined by electro-chemical machining while moving the object to be machined by the holding means.

Preferably, the wiper of the electro-chemical machining apparatus according to another preferred embodiment of the present invention is made from resilient material.

Alternatively, the wiper is provided with air vents.

Preferably, the air vents are provided in a wiper support for supporting the wiper.

Preferably, the wiper is designed to rotate about a given rotary axis.

The wiper made from elastic material is effective for machining the surface to be machined without causing damages. Also, provision of the air vents in the wiper or the support thereof or rotational movement of the wiper easily releases gas emitted from the surface to be machined by electrolytic reaction.

Preferably, the electrolytic solution supplying means of the electro-chemical machining apparatus according to another preferred embodiment of the present invention supplies electrolytic solution containing electrolyte and additive.

Preferably, the additive contains copper ions.

It is further preferable that the additive contains at least brightener or chelating agent.

Preferably, the electrolytic solution contains polishing particles.

It is therefore possible to performing electro-chemical machining for efficiently reducing steps or smoothing the metal film surface on the object to be machined while applying low pressure as a result of weakening the metal film by chelating or ionizing by anode oxidation.

Preferably, the power supply of the electro-chemical machining apparatus according to another preferred embodiment of the present invention supplies electrical current by applying repetitive pulse voltage between the surface of the object to be machined and the first electrode.

For example, the pulse duration is selected to be very short so that the metal film is anode oxidized very small amount per pulse, thereby avoiding sudden and large anode oxidation of the copper film which may cause spark discharge due to sudden change in the distance between electrodes by rough surface or sudden change in electric resistance by air bubble or particles. A series of small amounts of anode oxidation is the most effective.

It is further preferable that the power supply supplies electrical current by applying either square, sine wave, ramp or PAM pulse voltage between the surface of the object to be machined and the first electrode.

Preferably, the power supply is capable of varying electrical current flowing between the surface of the object to be machined and the first electrode at least in the initial stage and near the final stage of the machining.

Preferably, the power supply is set to flow larger electrical current at the initial stage and smaller electrical current in the final stage between the surface of the object to be machined and the first electrode.

Preferably, the electro-chemical machining apparatus according to another preferred embodiment of the present invention further comprises temperature adjustment means for adjusting the temperature of the electrolytic solution to be supplied from the electrolytic solution supply means.

It is preferable that the temperature adjustment means adjusts the temperature of the electrolytic solution at or below 80° C.

Anode oxidation may be accelerated by adjusting the temperature to about 80° C. or lower.

An electro-chemical machining apparatus according to another preferred embodiment of the present invention is preferably constructed to enclose the periphery of the object to be machined and a reservoir is provided to store the electrolytic solution supplied from the electrolytic solution supply means.

Alternatively, the electrolytic solution supply means supplies the electrolytic solution in such a manner to pour on the surface of the object to be machined.

Alternatively, the electrolytic solution supplying means includes at the end portion an exudation member from which the electrolytic solution is exuded onto the surface of the object to be machined.

The electrolytic solution may be supplied by either one of the above ways.

Preferably, in the electro-chemical machining apparatus according to another preferred embodiment of the present invention, the second electrode is made from a same or nobler metal metallic material than the metal film on the surface of the object to be machined.

This procedure prevents elution of the electrode material into the electrolytic solution, thereby positively anode oxidizing the metal film on the surface of the object to be machined. By doing so, it is not required to consider the material of the cathode because no elution takes place.

In the electro-chemical machining apparatus of another preferred embodiment of the present invention, the second electrode is preferably disposed in such a manner to contact a peripheral portion of the surface of the object to be machined.

Preferably, the second electrode is constructed to have a comb-like end portion that makes electrical contact with the peripheral portion of the surface of the object to be machined.

It is further preferable that the metal film has an extended portion at the side surface of the object to be machined.

The second electrode is disposed so as to make electrical contact at the extended portion of the object to be machined.

In each embodiment as mentioned above, the second electrode acts as the electrode to apply the voltage to the object to be machined by making electrical contact at the periphery thereof.

In the electro-chemical machining apparatus according to another preferred embodiment of the present invention, it is preferable that the second electrode is disposed at a location not to directly contact the peripheral portion of the surface of the object to be machined and electrical connection is made between the second electrode and the surface of the object to be machined by way of the electrolytic solution.

In this particular case where the second electrode is not directly contacted the periphery of the object to be machined, the electrolytic solution acts as a part of the connection circuit.

Alternatively, the second electrode is constructed as a removable cartridge.

Preferably, a negative voltage is applied to the first electrode while a positive voltage is applied to the second electrode.

In the electro-chemical machining apparatus according to another preferred embodiment of the present invention, the wiper is preferably mounted on the first electrode and an end portion of an insulation support, which supports and covers the first electrode.

Preferably, the wiper is mounted at the end of the insulation support by a rubber band or an O-ring.

That is, the wiper can be mounted in such a manner that the first electrode is covered with the rubber band or the O-ring.

Preferably, the electro-chemical machining apparatus of another preferred embodiment of the present invention is provided with means for varying the distance between the surface of the object to be machined and the first electrode.

In order to obtain a desired electrolytic current while the voltage is applied between the first electrode and the second electrode or the surface of the object to be machined, there is a need for varying the electric resistance between the first electrode and the surface of the object to be machined. The resistance depends on the resistivity of the material between the first electrode and the surface of the object to be machined and the distance between the first electrode and the surface of the object to be machined. It is therefore possible to obtain a predetermined electrolytic current by adjusting the distance between the surface of the object to be machined and the first electrode.

Preferably, the electro-chemical machining apparatus of another preferred embodiment of the present invention further comprises wiper pressing means for applying a pressure onto the wiper and an elastic member to transfer a pressure between the insulation support for supporting the first electrode and the wiper pressing means. The pressure of the wiper pressing means is transferred to the wiper by way of the elastic member.

Moreover, in order to alleviate the problems of the prior art as already mentioned above, an electro-chemical machining apparatus of another preferred embodiment of the present invention performs electro-chemical machining of an object to be machined having a metal film on the surface thereof. The apparatus comprises a holding means for holding the object to be machined, a wiper for wiping the surface of the object to be machined, a moving means for making relative movement of the wiper and the surface of the object to be machined, an electrolytic solution supplying means for supplying electrolytic solution onto the surface of the object to be machined, an electrode movably disposed at an opposite location to the surface of the object to be machined and a power supply for supplying electrical current between the surface of the object to be machined and the electrode.

The electro-chemical machining apparatus of another preferred embodiment of the present invention is utilized for machining the surface of an object to be machined having a metal film formed thereon. Electrolytic solution is supplied onto the surface of the object to be machined from electrolytic solution supplying means and electrical current is made to flow between the surface of the object to be machined and the electrode for anode oxidizing the metal film surface or chelating by reaction with chelating agent, thereby weakening the metal film surface so that the anode oxidized metal film surface is wiped off by the wiper which is relatively moved by the moving means. This provides efficient electro-chemical machining for easing the steps on the metal film surface or smoothing the surface with low pressure.

Preferably, the electro-chemical machining apparatus of another preferred embodiment of the present invention utilizes both anode and cathode as the electrode.

It is further preferable that the anode and the cathode are ring-shaped.

By movably disposing the ring-shaped anode and cathode in opposite position to the surface of the object to be machined, electrical current is made to flow through the surface of the object to be machined and the anode and cathode, thereby performing electrolytic removing.

It is preferable that the movably disposed electrode of the electro-chemical machining apparatus of another preferred embodiment of the present invention is the cathode and the anode is disposed in such a manner that the anode electrode makes electrical contact with the peripheral portion of the object to be machined.

Electrical contact of the anode electrode with the periphery of the surface of the object to be machined contributes to stabilize electrical current flowing through the surface of the object to be machined.

Preferably, the electrode of the electro-chemical machining apparatus of another preferred embodiment of the present invention is circular and rotatably provided.

Rotary driving of the circular electrode is effective for uniform electrolytic removing reaction within the electrode surface.

The electro-chemical machining apparatus of another preferred embodiment of the present invention is preferably constructed so that the electrode is non-contact with the surface of the object to be machined.

Electrical current is made to flow between the surface of the object to be machined and the electrode to cause electrolytic removing reaction in the non-contact condition between the anode and cathode electrodes and the surface of the object to be machined.

The electrode of the electro-chemical machining apparatus of another preferred embodiment of the present invention is preferably crescent-moon shaped and is disposed in a manner so as to cover at least a part of the peripheral surface of the object to be machined.

Preferably, the crescent-moon shaped electrode is the cathode.

It is further preferable that the recessed portion of the generally crescent-moon shaped electrode matches the shape of the circumference of the wiper so that a part of the wiper is in the recessed portion of the electrode, thereby the crescent-moon shaped electrode and the wiper fit to each other.

The electro-chemical machining apparatus according to another preferred embodiment of the present invention is to perform electro-chemical machining of an object to be machined having a metal film on the surface thereof. Such apparatus includes a holding means for holding the object to be machined, a wiper for wiping the surface of the object to be machined, a moving means for making relative movement of the surface of the object to be machined, a supplying means for supplying electrolytic solution to the surface of the object to be machined, an electrode movably disposed in a position opposed to the surface of the object to be machined, a power supply for supplying electrical current between the surface of the object to be machined and the electrode, and a reservoir for storing the electrolytic solution supplied from the means for supplying electrolytic solution; the surface of the object to be machined faces a bottom of the reservoir and contacts a circumferential portion of the object to be machined.

In case the object to be machined having a metal film on the surface thereof, the electro-chemical machining apparatus of another preferred embodiment of the present invention stores the electrolytic solution supplied from the electrolytic solution supplying means in the reservoir having the surface of the object to be machined as the bottom and contacting the circumferential surface thereof and electrical current is made to flow through the surface to be machined from the power supply for anode oxidizing the surface of the metal film on the surface to be machined and ionizing or chelating by reaction with chelating agent. Then, electro-chemical machining is performed by wiping the weakened metal film surface by the wiper, thereby efficiently easing the steps on the metal film surface or smoothing it.

Preferably, the power supply of the electro-chemical machining apparatus of another preferred embodiment of the present invention applies voltage between the first and second electrodes for removing the metal film from the surface of the object to be machined.

This is opposite to electroplating and used for easing the steps on the metal film surface on the object to be machined or smoothing it.

An electro-chemical machining apparatus according to another preferred embodiment of the present invention performs electro-chemical machining the object to be machined having a metal film on the surface thereof. Such apparatus includes a holding means for holding the object to be machined, a wiper for wiping the surface of the object to be machined, a moving means for making relative movement of the surface of the object to be machined and the wiper, an electrolytic solution supplying means for supplying electrolytic solution onto the surface of the object to be machined, a mesh electrode covered with the wiper and a power supply for supplying electrical current between the surface of the object to be machined and the electrode; the object to be machined is moved on the electrode covered with the wiper for electro-chemical machining.

In case of an object to be machined having a metal film formed on the surface thereof, the electro-chemical machining apparatus of the present invention supplies electrolytic solution onto the surface to be machined from the electrolytic solution supplying means and current is supplied between the mesh electrode covering the wiper and the surface to be machined. The metal film surface is weakened by ionizing as a result of anode oxidizing or chelating as a result of reaction with chelating agent so that the anode oxidized metal surface can be removed by the relative movement of the surface to be machined and the wiper, thereby performing efficient electro-chemical machining to ease steps and smoothing the metal surface on the object to be machined.

Preferably, in the electro-chemical machining apparatus of another preferred embodiment of the present invention, the holding means for holding the object to be machined rotates the object to be machined about a given axis.

Preferably, the electrode comprises both anode and cathode.

It is also preferable that the wiper is mounted on the wiper support in which the mesh electrode is provided.

The thickness of the wiper support is selected to vary the distance between the electrode and the surface to be machined.

Moreover, an electro-chemical machining apparatus according to another preferred embodiment of the present invention performs electro-chemical machining of an object to be machined having a metal film on the surface of the object to be machined. Such apparatus includes a holding means for holding the object to be machined, a wiper for wiping the surface to be machined, a moving means for moving the wiper in one direction with respect to the surface to be machined, an electrode disposed in a position opposed to the surface to be machined and a power supply for supplying electrical current between the surface to be machined and the electrode.

In case of machining, e.g., an object to be machined having a metal film on the surface to be machined, the electro-chemical machining apparatus operates in such a manner that the electrolytic solution supplying means supplies electrolytic solution onto the surface to be machined and the power supply supplies electrical current between the surface to be machined and the electrode disposed in the opposite position to the surface to be machined. The metal film surface is weakened by ionizing as a result of anode oxidation or chelating as a result of reaction with chelating agent so that the anode oxidized metal film can be removed by the wiper which moves in one direction with respect to the surface to be machined, thereby efficiently easing steps on the metal film surface or smoothing the metal film surface on the object to be machined with low pressure.

In the electro-chemical machining apparatus of another preferred embodiment of the present invention, the wiper is preferably a sheet-like wiper, i.e., the wiper is in a sheet form.

It is further preferable that the wiper includes a rolled form of the sheet-like wiper.

Preferably, the wiper is in a ring form constituted by coupling both ends of the sheet. The rolled or ring form wiper may be moved in one direction to wipe the surface to be machined.

Preferably, the electro-chemical machining apparatus another preferred embodiment of the present invention is provided with a contact electrode for making electrical contact with the surface to be machined. The contact electrode such as anode or the like is made contact with the surface to be machined for performing electrolytic removing reaction by supplying electrical current through the surface to be machined.

The electro-chemical machining apparatus of another preferred embodiment of the present invention is preferably constructed to use a sheet-like wiper against which the surface to be machined moves in a rocking manner.

The rocking movement of the surface to be machined in addition to the movement of the wiper in one direction contributes to uniform electro-chemical machining of the surface to be machined.

Preferably, according to the preferable electro-chemical machining apparatus of another preferred embodiment of the present invention, the moving means for moving the sheet-like wiper in one direction includes a plurality of rollers, a part of which being opposed to the surface of the object to be machined with a constant distance.

It is further preferable that the roller disposed in a constant distance from the surface to be machined constitutes the electrode.

Preferably, the roller disposed with a constant distance from the surface to be machined is the cathode.

It is also preferable that the moving means for moving the sheet-like wiper in one direction includes a plurality of rollers, a part of which being provided with a resilient member for pressing the sheet-like wiper against the surface to be machined.

The preferred embodiments of the present invention provide electro-chemical machining that can be performed under low pressure to ease steps on the metal film surface or smoothing the surface. This is advantageous in many aspects including reduced scratches, easing steps, avoiding dishing and erosion as compared to the conventional simple mechanical polishing, as already mentioned. It is therefore very convenient for machining such objects as an organic low dielectric constant film or a porous low dielectric constant insulation film as the interlayer insulation film.

BRIEF DESCRIPTION OF THE DRAWINGS

The above and other objects, features and advantages of the present invention will become more apparent to those skilled in the art from the following description of the presently preferred exemplary embodiments of the invention taken in conjunction with the accompanying drawings, in which:

FIG. 1 is the step for forming an insulation film on a semiconductor substrate; FIG. 2 is a step for forming contact holes and wiring grooves; and FIG. 3 is a step for applying a barrier film;

FIG. 4 is a step for forming a copper film as a seed film and FIG. 5 is a step for forming a copper film;

FIG. 6 is a step for anode oxidizing the copper film and FIG. 7 is a step for applying a chelating film;

FIG. 8 is a step for removing the chelating film at raised portions and FIG. 9 is a step for applying a chelating film again;

FIG. 10 is a step for flattening the copper film, FIG. 11 is a step for removing excessive copper film and FIG. 12 is a step to expose the barrier film;

FIG. 34 is a step for forming an interlayer insulation film; FIG. 35 is a step for forming wiring groves and contact holes and FIG. 36 is a step for applying a barrier film;

FIG. 37 to FIG. 39 show subsequent steps to FIG. 36, in which FIG. 37 is a step for forming a seed film, FIG. 38 is a step for forming a wiring layer and FIG. 39 is a step for forming wirings;

DESCRIPTION OF THE PREFERRED EMBODIMENTS OF THE INVENTION

Various embodiments of the electro-chemical machining apparatus according to the present invention to be used for, e.g., fabrication of semiconductor devices will be described in detail by reference to the accompanying drawings, namely FIG. 1 to FIG. 33B.

(First Preferred Embodiment)

A first embodiment of the electro-chemical machining apparatus according to the present invention will be described by way of an example of applied to metal wiring fabrication steps for semiconductor devices by a dual damascene process.

Semiconductor device fabrication process applying the electro-chemical machining apparatus according to the present invention will be described hereafter.

Figure 1:
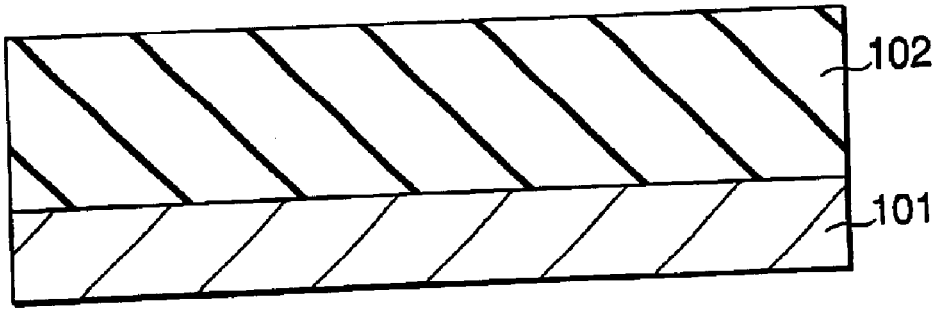
FIG. 1 to FIG. 3 illustrate cross sectional views for various steps of fabricating semiconductor devices according to a preferred embodiment of the present invention.

Firstly, as illustrated in FIG. 1, an interlayer insulation layer 102 of, e.g., silicon oxide film is provided on a semiconductor substrate 101 of, e.g., silicon having impurity diffused regions (not shown in FIG. 1). Such interlayer insulation layer 102 is provided by a reduced pressure chemical vapor deposition (CVD) technique using, e.g., TEOS (tetraeethylortheosilicate) as a reaction source. A silicon nitride film and other so-called low-k (low dielectric constant) materials as well as the TEOS film may be used as the interlayer insulation film 102. The low dielectric constant materials include SiF, SiOCH, polyallylether porous silica, polyamide, etc.

Figure 2:
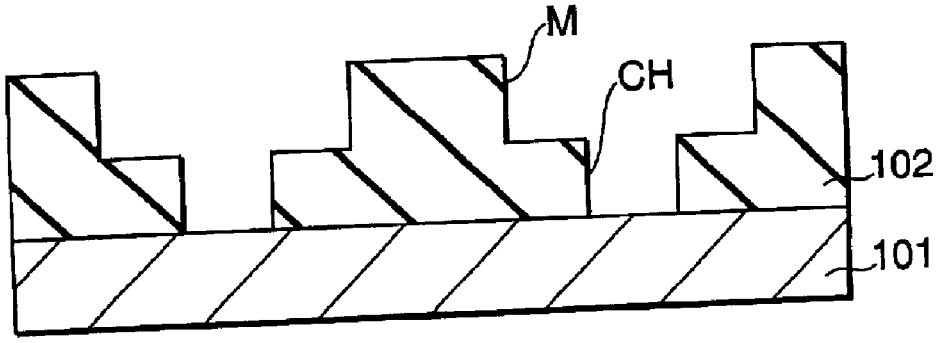

Subsequently, as illustrated in FIG. 2, contact holes CH reaching the impurity diffused regions in the semiconductor substrate 101 and wiring grooves M are formed in the interlayer insulation film 102 using, e.g., conventional photolithography and etching techniques. A depth of the wiring grooves is, e.g., about 800 nm.

Figure 3:
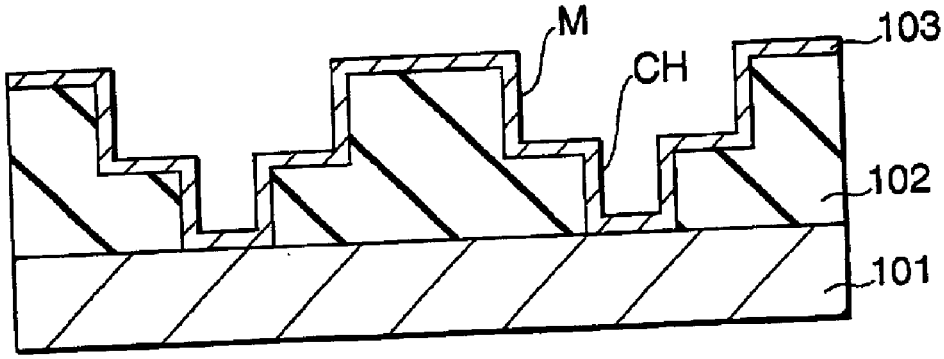

A next step is illustrated in FIG. 3 in which a barrier film 103 is applied on the surface of the interlayer insulation film 102 as well as in the contact holes CH and the wiring grooves M. The barrier film 103 includes, e.g., Ta, Ti, W, Co, Si or Ni, or alloys or laminations of these metals and phosphor or nitrogen including TaN, TiN, WN, CoW, CoWP, TiSiN, NiWP, etc. The barrier film 103 including the above materials is formed to the thickness of, e.g., about 25 nm by a conventional physical vapor deposition (PVD) technique using a sputtering machine, a vapor deposition machine or the like, or, still, the CVD technique. The barrier film 103 acts to prevent the wiring material from diffusing into the interlayer insulation film 102 or to improve adherence of the wiring material with the interlayer insulation film 102. For example, in a case where the wiring material is copper and the interlayer insulation film 102 is made from silicon oxide, the barrier film 103 is essential because copper has a large diffusion coefficient against the silicon oxide, thereby easily oxidizing the copper.

Figure 4:
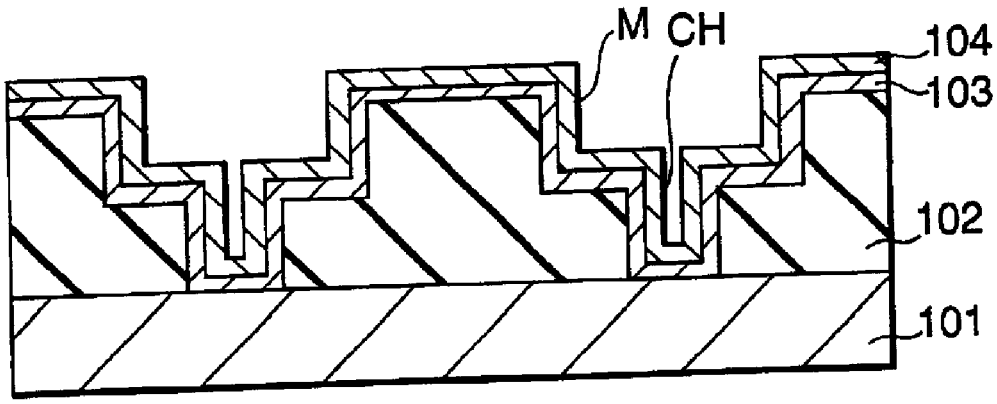
FIG. 4 and FIG. 5 illustrate subsequent steps to FIG. 3, according to a preferred embodiment of the present invention.

A next step is illustrated in FIG. 4 and it is directed to forming a seed film 104 of a same material as the wiring material on the barrier film 103. The seed film 104 is formed by a conventional sputtering technique to a thickness of, e.g., about 150 nm. The seed film 104 is used for subsequent electrolytic plating and accelerating metal film growth, e.g., in the wiring grooves M and the contact holes CH.

Figure 5:
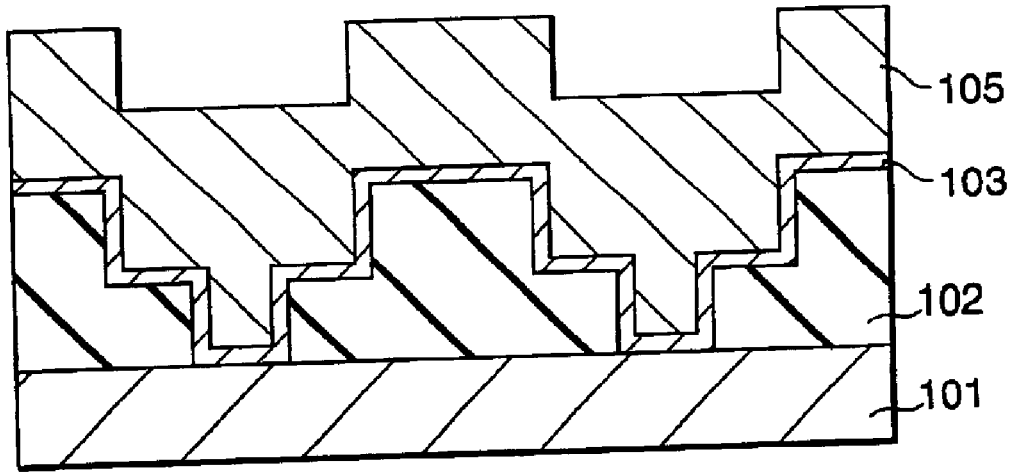

A next step is illustrated in FIG. 5 and it is directed to forming a wiring layer 105 including Al, W, WN, Cu, Au or Ag or alloy of these metals on the barrier film 104 to the thickness of, e.g., about 1600 nm. The wiring layer 105 is formed preferably by the electrolytic plating or electroless plating technique, however either CVD, PVD or sputtering technique may also be applied. The seed film 104 is integrated with the wiring layer 105. The surface of the wiring layer 105 may have projections and hollows of, e.g., about 800 nm in height and depth. The following descriptions are made on an example of using copper as the wiring layer 105.

The fabrication steps described above are similar to existing conventional processes. However, in the electro-chemical machining process according to the present invention, the excessive wiring layer 105 on the interlayer insulation film 102 is removed by electro-chemical machining rather than a chemical mechanical polishing (CMP) technique. Specifically, the copper film is ionized by anode oxidation using electrolytic action or by chelating the film surface so that the film surface is weak to be easily removed or wiped off by a wiper.

Figure 6:
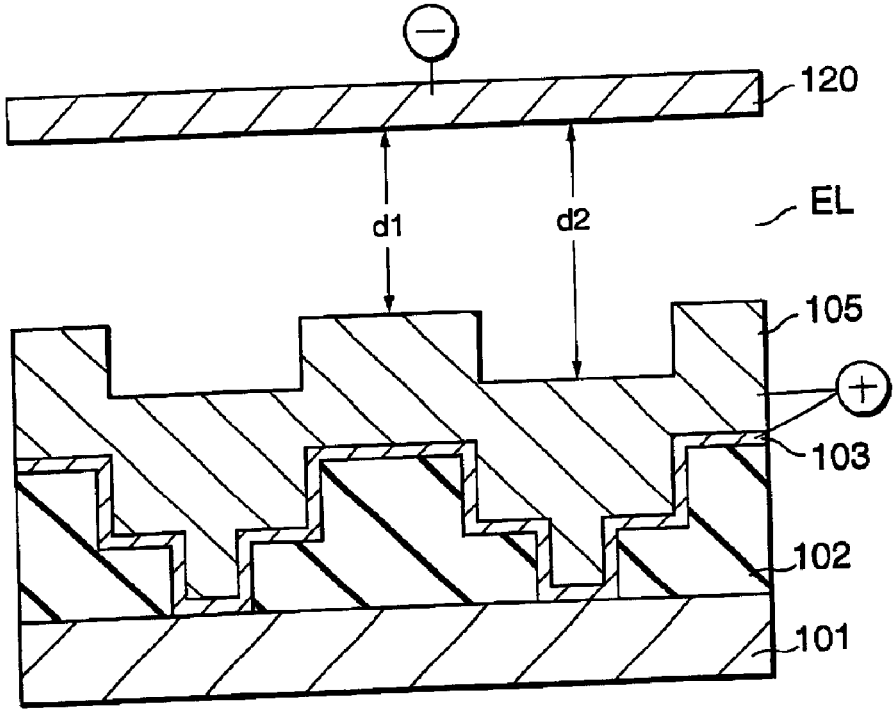
FIG. 6 and FIG. 7 illustrate subsequent steps to FIG. 5, according to a preferred embodiment of the present invention.

A method of forming the chelating film is illustrated in FIG. 6. A cathode member 120 is disposed above and in parallel with the copper film 105 and an electrolytic solution EL including electrolyte and additive, e.g., copper chelating agent is placed between the cathode member 120 and the copper film 105. It has to be noted that the cathode member 120 and the electrolytic solution EL are excluded in FIG. 4 and subsequent figures. The electrolytic solution may include brightener, Cu ions, etc. other than the one as mentioned above. Preferably, the electrolytic solution is temperature controlled to optimize oxidation of the metal film surface, chelating rate and wiping rate.

Preferable chelating agents to be use for the particular purpose include quinaldine acid as given by the chemical formula (1), glycine as given by the chemical formula (2), citric acid as given by the chemical formula (3), oxalic acid as given by the chemical formula (4) and propionic acid as given by the chemical formula (5).

(chemical formula 1)

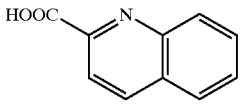

(1)

(chemical formula 2)

$NH_2\ CH_2\ COOH$ (2)

(chemical formula 3)

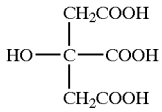

(3)

(chemical formula 4)

$(COOH)_2$ (4)

(chemical formula 5)

$C_2\ H_5\ COOH$ (5)

The copper film 105 acting as an anode is anode oxidized to form CuO. In FIG. 6, since a distance d1 between the raised surface of the copper film 105 and the cathode member 120 is shorter than the distance d2 between the hollowed surface portion of the copper film 105 and the cathode 120, current density is higher at the raised portions as compared to the hollowed portions, thereby accelerating anode oxidation at the raised portions.

Figure 7:
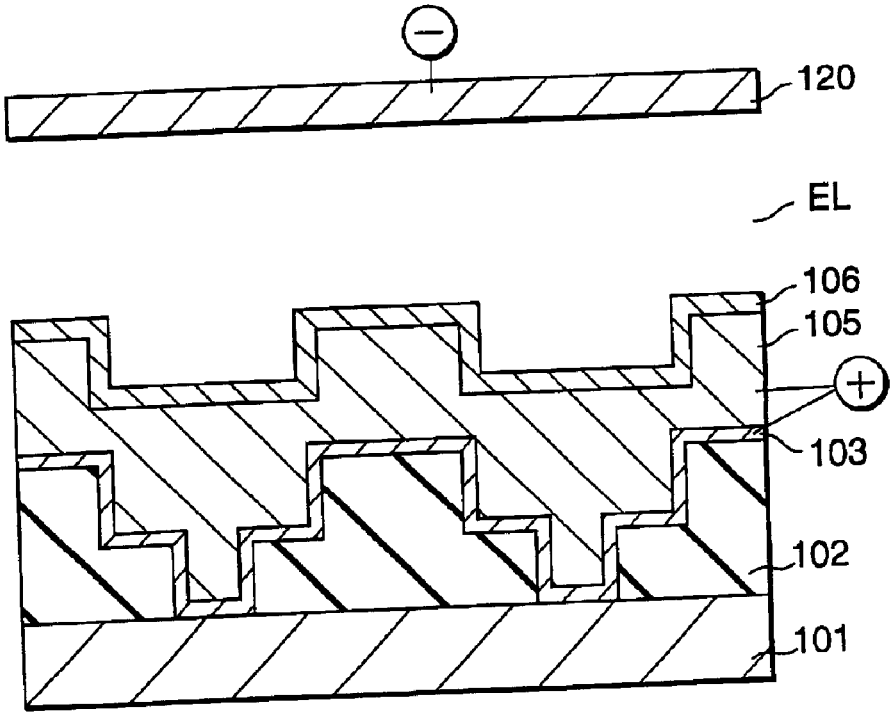

As shown in FIG. 7, the surface of the anode oxidized copper film (CuO) 105 is chelated by the chelating agent in the electrolytic solution. In a case where quinaldine acid is use as the chelating agent, the film forms the chelation compound as given by the chemical formula (6). If glycine is used, the film forms the chelation compound as given by the chemical formula (7). Such chelation film 106 has higher electric resistance as compared to copper and exhibits very low mechanical strength. Consequently, less current flows from the copper film 105 to the cathode 120 through the electrolytic solution EL after the chelation film 106 has been formed on the copper film 105. The chelation of the copper is suppressed before anode oxidation.

(chemical formula 6)

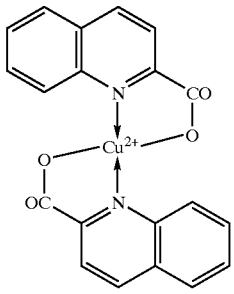

(6)

(chemical formula 7)

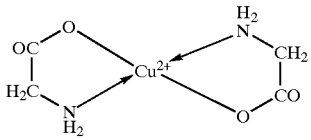

(7)

Figure 8:
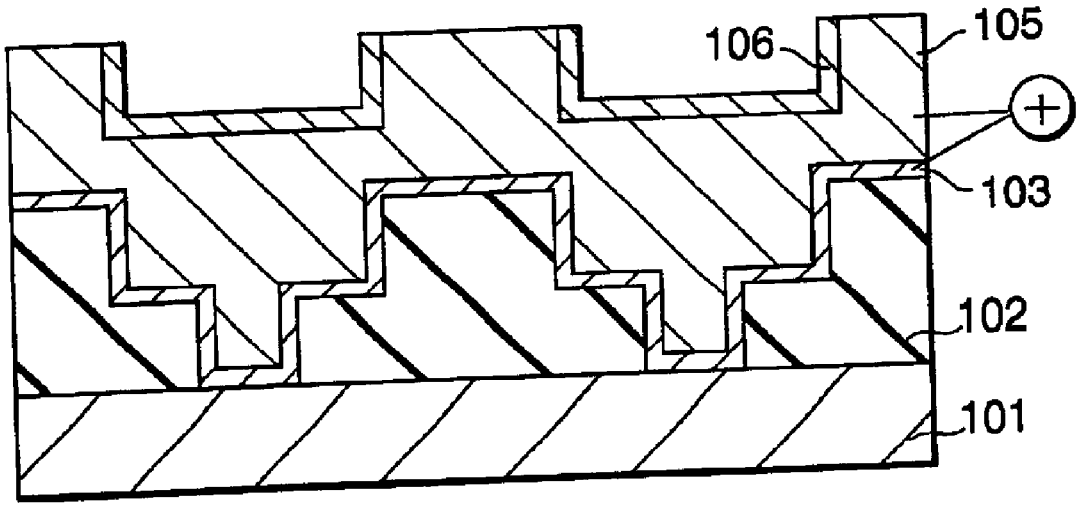
FIG. 8 and FIG. 9 illustrate subsequent steps to FIG. 7, according to a preferred embodiment of the present invention.

Now, reference is made to FIG. 8 for selectively removing the raised portions of the chelation film 106 by wiping, mechanical polishing or the like. In case of removing the chelation film 106 by mechanical polishing or the like, slurry (not shown) may be included in the electrolytic solution EL in advance. Since the chelation film 106 has relatively low mechanical strength, the chelation film 106 may be easily removed by vibrating the substrate 101 or by jet streaming the electrolytic solution. It is to be noted that electric current from the copper film 105 to the cathode 120 through the electrolytic solution EL increases because the raised portions of the copper film 105 having lower electric resistance are exposed in the electrolytic solution EL.

Figure 9:
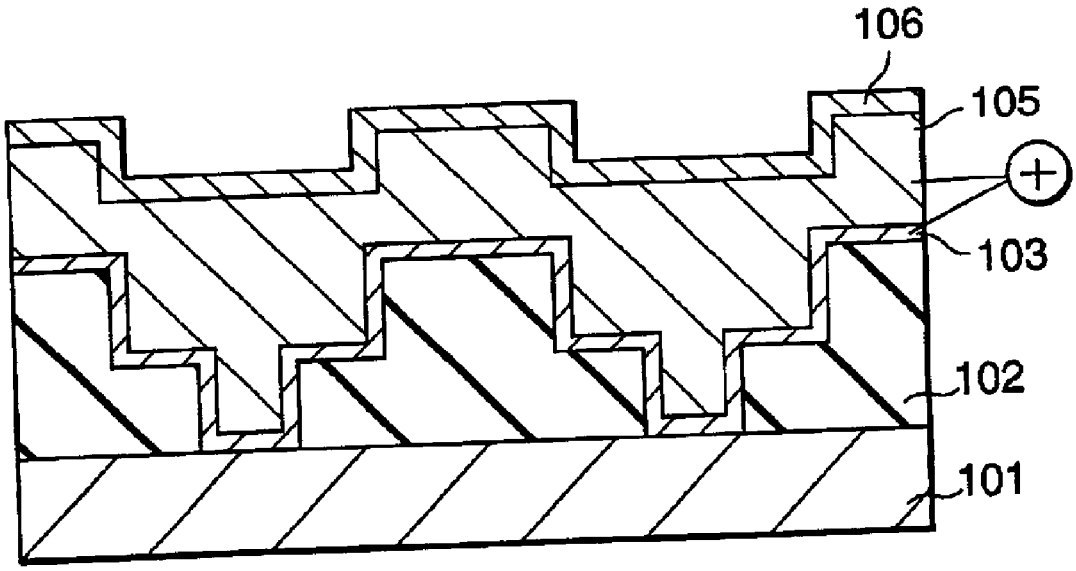

Referring now to FIG. 9, raised portions of the copper film 105 exposed to the electrolytic solution have lower electric resistance and have shorter distance to the cathode 120, thereby being anode oxidized relatively rapidly and chelating the anode oxidized copper. The electrical current flowing from the copper film 105 to the cathode 120 through the electrolytic solution decreases again. Subsequently, raised portions of the chelation film 106 are selectively removed by wiping or the like. The exposed copper film is, then, anode oxidized, chelated and selectively wiped. Such process is repeated. The current from the copper film 105 to the cathode 120 through the electrolytic solution EL increases immediately after wiping off the chelation film 106 and decreases as the chelation film 106 is developed.

Figure 10:
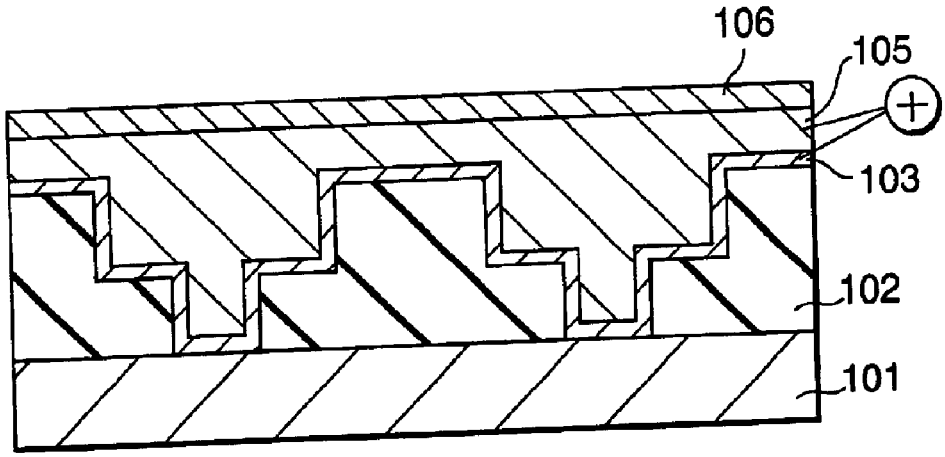
FIG. 10 to FIG. 12 illustrate subsequent steps to FIG. 9, according to a preferred embodiment of the present invention.

After completion of the above process, the copper film 105 is flattened, as illustrated in FIG. 10.

Figure 11:
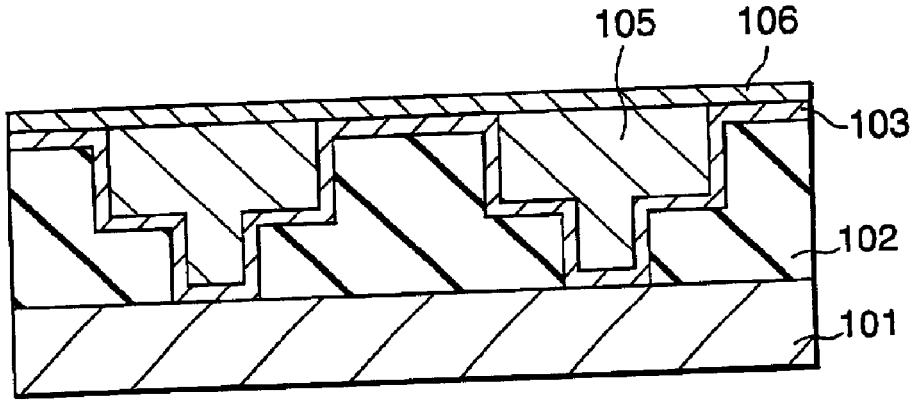

The flattened copper film 105 is further removed by the wiping or the like and the current from the copper film 105 to the cathode 120 through the electrolytic solution EL will reach a first maximum value. The anode oxidation, development of the chelation film 106 and removing the chelation film 106 are continued until excessive copper film 105 on the barrier film 103 is deplete as illustrated in FIG. 11.

Figure 12:
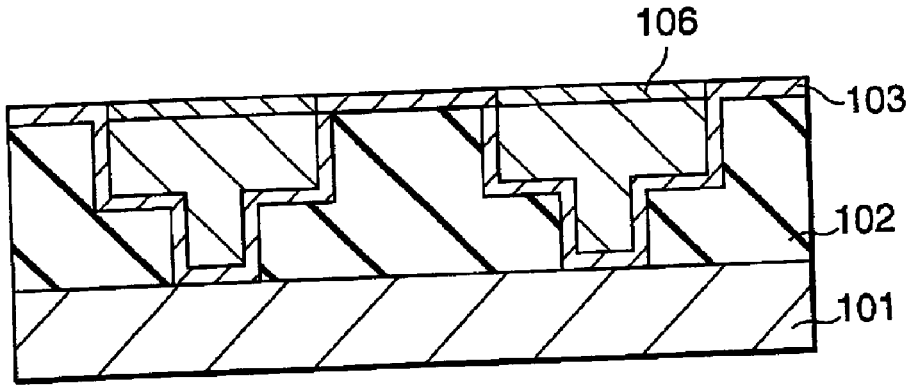
Figure 13:
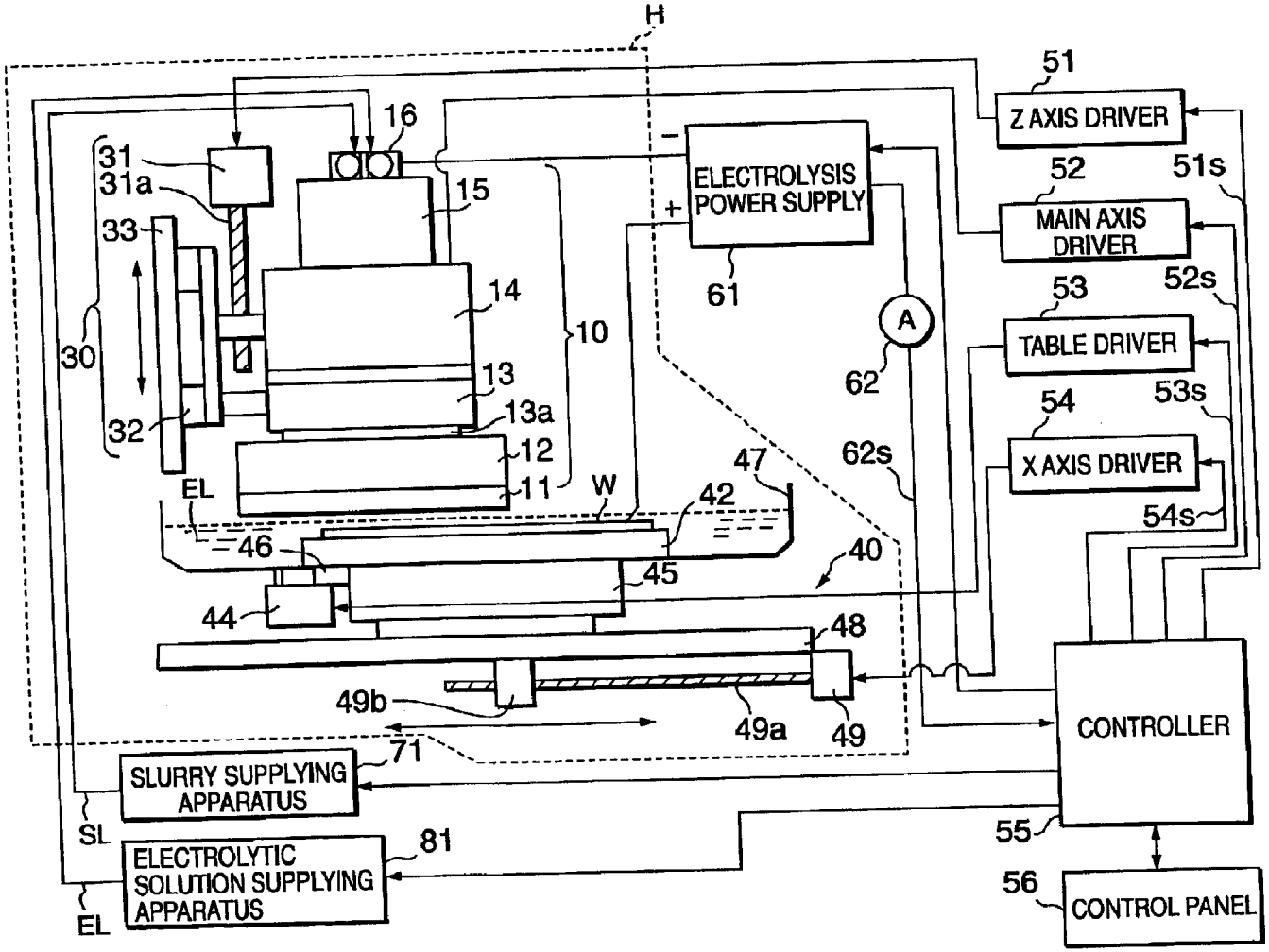
FIG. 13 is a schematic diagram of an electro-chemical machining apparatus according to a first preferred embodiment of the present invention.

Then, the surface of the barrier film 103 will be exposed by continuing the above wiping process on the entire surface of the copper film 105 as illustrated in FIG. 12. Since the barrier film 103 has higher electric resistance, electrical current value after removing the chelation film 106 starts to drop. This is the time (termination point) to reduce applied voltage and then stopping applying voltage, thus stopping further proceeding of the chelation by anode oxidation.

With the above process, it is possible to achieve flattening of the initial rough surface of the copper film 105.

Subsequently, the barrier film 103 deposited outside the wiring grooves are removed to provide the copper wirings.

According to an electro-chemical machining method that applies the present invention, excessive metal (copper) film is electrochemically removed with significantly lower machining pressure as compared to the normal chemical mechanical polishing technique. This is advantageous in reducing scratches, steps, dishing, erosion associated with simple mechanical polishing. The low pressure electro-chemical machining is also very convenient for applying to the interlayer insulation film 102 made from organic, low dielectric constant, porous low dielectric constant insulation film which has weak mechanical strength and is easy to break by normal chemical mechanical polishing technique.

In a convention chemical mechanical polishing process using slurry containing alumina particles, the alumina particles may be left behind or are buried in the copper surface after contribution to CMP machining, thereby causing problems afterward. On the other hand, as far as the electro-chemical machining method according to the present invention is concerned, electrolytic solution containing a chelating agent is used and the chelation film on the surface has very weak mechanical strength so as to be easily removed by wiping or the like using electrolytic solution containing no polishing particles.

In addition, as an electrolytic current is monitored for controlling the electro-chemical machining, it is possible to perform monitoring of a progress of the electro-chemical machining process.

The electro-chemical machining method applying the electro-chemical machining apparatus according to the present invention is not limited to the above embodiment. It can be applied to wiring layers including a material other than copper, e.g., Al, W, WN, Cu, Au, Ag or alloy of these materials. It is also applicable to electro-chemical machining of the barrier film made from the above materials. It can be applied to electro-chemical machining of various metal films other than wirings. Also, the chelating agent and the cathode may be made from other materials without departing from the scope and subject matter of the present invention. It has to be observed that the method of fabricating semiconductor devices applying the electro-chemical machining apparatus according to the present invention is not limited to the above embodiment. For example, the present invention has no restriction other than electro-chemical machining of metal film and thus it can be applied to a single damascene process rather than the above mentioned dual damascene process. The ways of forming the contact holes, the wiring grooves and the barrier film can be modified without departing from the scope of the present invention.

Now, a structure of embodiments of the electro-chemical machining apparatus according to the present invention will be described below. FIG. 6 illustrates the construction of the embodiment of the electro-chemical machining apparatus according to the present invention. The electro-chemical machining apparatus in FIG. 13 comprises a machining head portion H, an electrolytic power supply 61, a controller 55 for controlling the overall operation of the electro-chemical machining apparatus and an electrolytic solution supplying apparatus 81. A slurry supplying apparatus 71 may be added if necessary. Although not shown in FIG. 13, the electro-chemical machining apparatus in this embodiment is installed in a clean room equipped with an input/output port for carrying in and out a wafer cassette containing wafers which are objects to be machined. Also provided is a wafer transportation robot between the electro-chemical machining apparatus and the input/output port for handling wafers to the electro-chemical machining apparatus from the wafer cassette brought into the clean room through the input/output port or vice versa.

The machining head portion H includes an electro-chemical machining tool holder 10 for holding an electro-chemical machining tool 11 while rotating it, if necessary, a Z-axis positioning mechanism (positioning means) 30 for positioning the electro-chemical machining tool holder 10 in the Z-axis and an X-axis moving mechanism (rotatable holding means and relative moving means) 40 for holding, rotating and moving in the X-axis the wafer W, the object to be machined.

The Z-axis positioning mechanism 30 includes a Z-axis servo motor 31 mounted on a column (not shown in FIG. 13), ball screw shaft 31*a* coupled to the Z-axis servo motor 31, a Z-axis slider 32 coupled to a holding device 13 and a main shaft motor 14 and having a screw portion, and a guide rail 33 provided on the column (not shown) for holding the Z-axis slider 32 movably in the Z-axis direction.

The Z-axis servo motor 31 is driven to rotate upon receiving a driving current from the Z-axis driver 51 connected to the Z-axis servo motor 31. The ball screw shaft 31*a* is positioned along the Z-axis and having one end connected to the Z-axis servo motor 31 and the other end rotatably held by the holding member provided onto the above mentioned column (not shown), thereby being coupled to the screw portion of the Z-axis slider 32.

The above construction allows that the ball screw shaft 31*a* to rotate by being driven by the Z-axis and movably positioning the electro-chemical machining tool 11 held by the electro-chemical machining tool holder 10 at any position in the Z-axis direction. Positioning accuracy of the Z-axis positioning mechanism 30 is, e.g., about 0.1 $\mu$m in resolution.

The X-axis moving mechanism 40 comprises a wafer table 42 for chucking the wafer W, a driving motor 44 for supplying driving power to rotate the wafer table 42, a belt 46 for coupling the driving motor 44 and a rotary shaft of the holder device 45, an electrolytic solution bath 47 disposed on the holder device 45, an X-axis slider 48 on which the driving motor 44 and the holder device 45 are disposed, an X-axis servo motor 49 disposed on a table (not shown), a ball screw shaft 49*a* connected to the X-axis servo motor 49, and movable member 49*b* having a screw portion for mating with the ball screw shaft 49*a* coupled to the X-axis slider 48.

The wafer table 42 is designed to, e.g., vacuum suck the wafer W by a vacuum means. The driving motor 44 is connected to a table driver 53 from which the driving current is supplied. The driving current is controlled for rotating the wafer table 42 at a desired number of revolutions. The X-axis motor 49 is connected to an X-axis driver 54 for rotating upon receiving driving current therefrom and the X-axis slider 48 is driven in the X-axis direction by way of the ball screw shaft 49*a* and the movable member 49*b*. The driving current to be supplied to the X-axis motor 49 is controlled for controlling the velocity of the wafer table 42 in the X-axis direction.

The electrolytic solution supplying apparatus 81 supplies electrolytic solution containing electrolyte and additive onto the wafer W by way of a supply nozzle (not shown). Preferably, the electrolytic solution is adjusted to the temperature of about 80° C. or lower for accelerating anode oxidation. The electrolytic solution EL is stored in the electrolytic solution bath (or reservoir) 47 for supplying electrolytic solution onto the surface to be machined of the wafer W. It is also possible that a sufficient amount of the electrolytic solution EL may be provided on the surface to be machined of the wafer W wherein the electrolytic solution EL is held thereon by surface tension. After a predetermined, the wafer table 42 is rotated in order to substantially remove the electrolytic solution EL on the wafer. As described hereinafter, it is also possible to make the wiper from a material from which electrolytic solution exudates onto the wafer.

Electrolyte may be organic solution or aqueous solution base. The electrolyte may contain, e.g., copper sulfate, ammonium sulfate, phosphoric acid, etc. as acid and, e.g., ethyldiamine, NaOH, KOH, etc. as alkali. Also, it is possible to use mixed weak solution of organic solvent such as methanol, ethanol, glycerol and ethylene glycol as electrolyte. Cu ions, brightener or chelating agent may be used as additive. For example, sulfur family, copper ion family such as copper hydroxide and copper phosphate, chlorine ions family, benzothoriazole (BTA) and polyethylene glycol may be used as brightener. For example, quinoline, anthranilic acid or the like other than the abovementioned quinaldine acid, glycine citric acid, oxalic acid and propionic acid may be used as chelating agent.

The slurry supplying apparatus 71 supplies slurry onto a wafer W from a nozzle (not shown). Used as slurry is, e.g., an oxidizing aqueous solution including primarily hydrogen peroxide, ferric nitrate, potassium iodate or the like and small amount of polishing particles of aluminum oxide (alumina), cerium oxide, silica, germanium oxide or the like. In addition, slurry may be supplied as a need arises.

Figure 14:
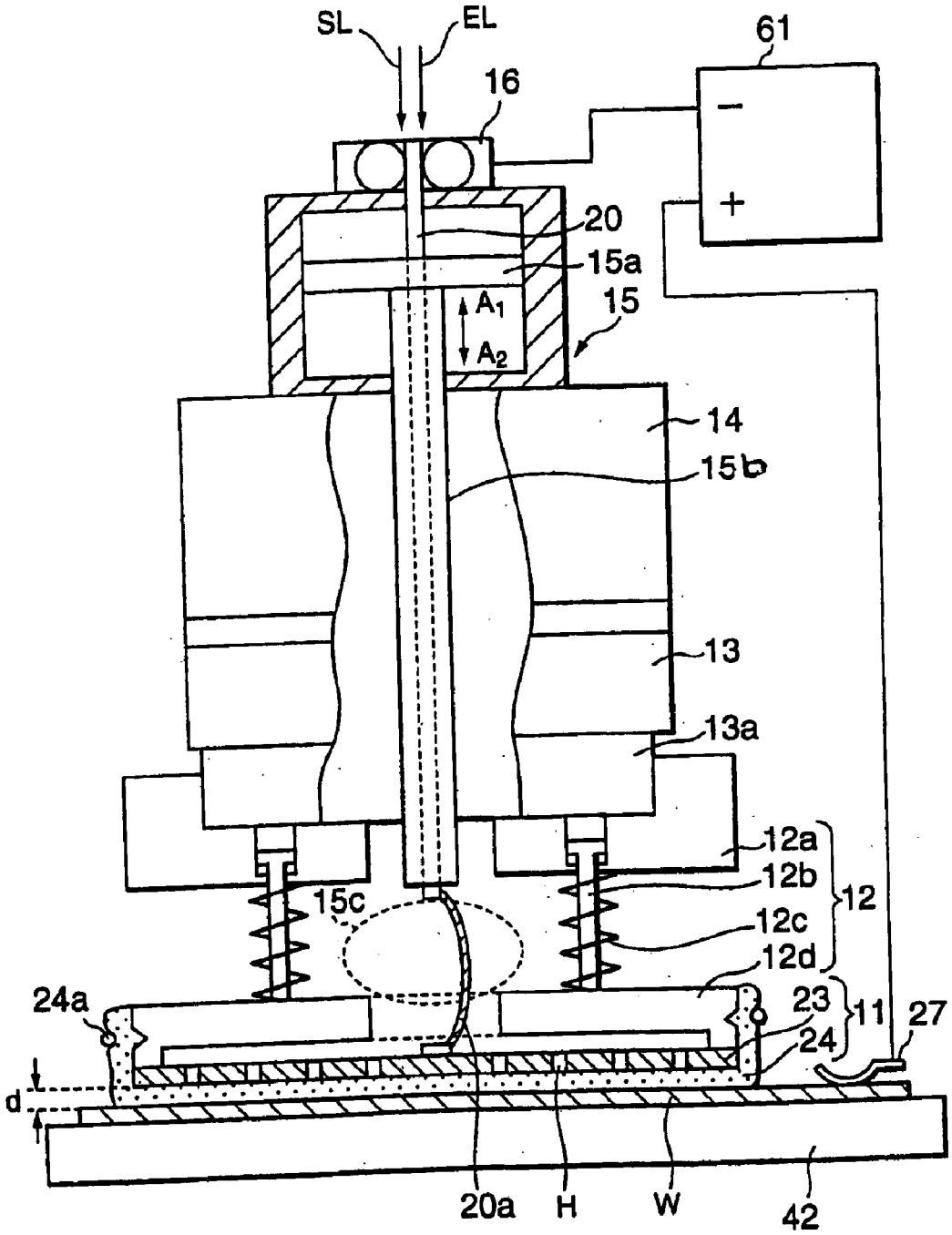
FIG. 14 is a schematic diagram illustrating a structure of the machining tool holding portion of the electro-chemical machining apparatus according to the first preferred embodiment of the present invention.

Further, a construction of the electro-chemical machining tool holder portion 10 of the electro-chemical machining apparatus according to a preferred embodiment of the present invention is illustrated in FIG. 14. The electro-chemical machining tool holder portion 10 includes a holder member 12 having a mechanism for holding the electro-chemical machining tool 11 while applying pressure thereto, a holding apparatus (device) 13 for holding the holder member 12 in such a manner as to rotate by way of a main shaft 13*a* held by the holding apparatus 13 and a cylinder apparatus 15 provided on the main shaft motor 14.

The main shaft motor 14 comprises, e.g., a direct driving motor including a rotor (not shown) coupled to the main shaft 13*a*. Also, the main shaft motor 14 is provided with a through-hole at the center portion for insertion of a piston rod 15*b* of the cylinder apparatus 15. The main shaft motor 14 is driven by a driving current supplied from a main shaft driver 52. The holding apparatus 13 is provided with, e.g., an air bearing for rotatably holding the main shaft 13*a*. The main shaft 13*a* of the holding apparatus 13 is also provided with a through-hole at the center portion for insertion of the piston rod 15*b*.

The holding member 12 comprises a coupling member holder 12*a*, a coupling member 12*b*, a resilient member 12*c* and an insulation plate 12*d* made from POM or other material. The insulation plate 12*d* is coupled to the coupling member holder 12*a* by a plurality of rod-shaped coupling members 12*b*. The coupling members 12*b* are disposed at a constant radius position from the center axis of the insulation plate 12*d* and held movably with respect to the coupling member holder 12*a*. This particular construction allows the insulation plate 12*d* to move in the axial direction of the coupling member holder 12*a*. Also provided between the insulation plate 12*d* and the coupling member holder 12*a* are the resilient member 12*c* made of a coil spring for applying a spring force of, e.g., 1 kg per each coupling member 26.

There is provided on the bottom surface of the insulation plate 12*d*, an electrode plate 23 acting as a cathode of the electro-chemical machining tool 11. A wiper 24 is mounted in such a manner so as to cover the electrode plate 23 and the insulation plate 12*d* using an O-ring 24*a*. The wiper 24 has a surface made from soft brushing material, sponge material, porous material or other elastic material for wiping the wafer W fixedly placed on a wafer table 42. The wiper 24 is made from, e.g., porous material such as polyvinyl acetal (PVA), (poly)urethane foam, Teflon® brand foam, non-woven Teflon® fabric, melamine resin, epoxy resin, etc. Required electrical characteristics of the material for the wiper include insulation that does not conduct electricity and ions. A fiber material is preferable for this and also for its capability to have pores that are filled with electrolytic solution in order to wet the gap between the electrode 23 and the wafer W. Also, such wiper 24 is capable of wiping the wafer W surface without causing any scratches or the like.

Since the holder member 12 holding the electro-chemical machining tool 11 is coupled to the main shaft 13*a* of the holding apparatus 13, rotation of the main shaft 13*a* allow the machining tool 11 to rotate.

The cylinder apparatus 15 is mounted on a case of the main shaft motor 14 and has a piston 15*a*, which is driven in either one of the directions as indicated by arrows A1 and A2 by, e.g., air pressure supplied into the cylinder apparatus 15. The piston 15*a* is coupled to a piston rod 15*b* that extends through the main shaft motor 14 and the holding apparatus 13. For example, a pressure member 15*c* is coupled to the end of the piston rod 15*b* between the insulation plate 12*d* in such a manner to change its position within a certain extent. The pressure member 15*c* is made to contact to the peripheral portion of the opening portion of the insulation plate 12*d* disposed at the opposite position for pressing the insulation plate 12*d* by the piston rod 15*b* driven in the direction of the arrow A2.

As mentioned above, the insulation plate 12*d* is held movably with respect to the coupling member holder 12*a* while the insulation plate 12*d* and the coupling member holder 12*a* are coupled by the resilient member 12*c*. As high pressure air is supplied to the cylinder apparatus 15 to move the piston rod 15*b* downwardly as indicated by the arrow A2, the pressure member 15*c* pushes down the insulation plate 12*d* against the restoring force. This accompanies with the downward movement of the wiper 24. The restoring force may be set to a predetermined value by adjusting the spring force or the number of the resilient members 12*c*. Upon termination of supplying the high pressure air to the cylinder apparatus, the restoring force of the resilient members 12*c* pulls up the insulation plate 12*d* as well as the wiper 24.

The piston rod 15*b* of the cylinder apparatus 15 is formed with the through-hole at the center portion for fixedly receiving an electrically conductive shaft 20. The current carrying shaft 20 is made from a suitable electrically conductive material and has an upper end extending through the piston 15*a* to a rotary joint 16 provided on the cylinder 15. On the other hand, the lower end of the conductive shaft 20 extends through the main shaft 13*a* and is connected to an electrode plate 23 by way of a wiring 20*a*.

The electrode plate 23 is made from an electrically conductive material and is electrically connected to a minus electrode (cathode) of an electrolytic power supply 61 by way of the conductive shaft 20. Accordingly, there is no restriction to the material of the electrode plate 23. Preferably, the electrode plate 23 is formed with venting holes H for venting gas from the surface of the electrochemical machining object, e.g., wafer W The gas is produced as a result of electrolytic reaction of the metal film on the wafer W The venting holes H are formed to avoid disadvantage caused by the gas such as unequal electrolytic reaction between the electrode plate 23 and the wafer W For example, 16 venting holes of 3.2 mm in diameter are formed in a copper electrode plate of 150 mm in diameter and 1 mm in thickness. Alternatively, the electrode plate 23 may be constructed to rotate for diffusing the gas produced by the electrolytic reaction from the space between the wafer W and the electrode plate 23.

On the other hand, an electrically conductive brush 27 is fixedly disposed on the surface to be machined at the peripheral portion of the wafer W in such a manner that the electrically conductive brush 27 makes contact with the surface of the wafer W to be machined.

As the electrically conductive brush 27 is electrically connected to a plus electrode (anode) of, e.g., the electrolytic power supply 61, it is preferable that the brush 27 is made from copper or nobler metal than, for example, the copper film formed on the wafer W.

The electrically conductive shaft 20 is formed with a through-hole at the center portion for supplying the electrolytic solution EL containing chelating agent onto the wafer W Alternatively, it is possible to use other supply means such as storing the electrolytic solution in an electrolytic solution reservoir. It is also possible to supply chemical polishing agent (slurry) SL through the through-hole in the electrically conductive shaft 20, which acts as an electrical connection between the rotary joint 16 and the electrode plate 23. The rotary joint 20 makes an electrical connection to, e.g., the minus electrode of the electrolytic power supply 61 so as to keep supplying electrical current to the rotating electrically conductive shaft 20.

The electrolytic power supply (current supply means) 61 supplies a predetermined voltage between the abovementioned rotary joint 20 and the electrically conductive brush 27. Application of the voltage between the rotary joint 20 and the electrically conductive brush 27 develops a potential difference between the copper film on the surface of the wafer W (an object to be electrically machined) and the electrode plate 23 by way of the wiper 24. Preferably, the electrolytic power supply 61 is, e.g., a power supply including a switching regulator circuit to output voltage pulse of a constant repetition rate rather than a constant voltage power supply for supplying a constant voltage. For example, the electrolytic power supply 61 supplies pulse output of a constant repetition rate but controllable pulse width to either one of 1, 2, 5, 10, 20 or 50 ms with the output voltage of 5V (DC) and the maximum output current of 2~3A.

The reason of choosing such short duration pulse voltage is to decrease the amount of anode oxidation per pulse. This is effective to achieve a series of minimum machining by avoiding transient and significant anode oxidation of the copper film which may occur by sparks, air bubbles or particles when the electric resistance changes suddenly as a result of the change in the distance between the electrodes and the irregular surface of the copper film on the surface of the wafer W. Since the output voltage is relatively high as compared to the output current, there is a certain margin in setting the distance between the electrodes. In other words, slight change in the distance between the electrodes causes minimum change in the current because of the use of relatively high output voltage. It is to be noted, however, that the applied pulse is not restricted to the above example and that the repetitive pulse may be rectangular pulse, sine wave, ramp, triangle or PAM.

For example, the voltage may be a repetitive positive voltage pulse having about 5~10 ms pulse width or may have 20~50 ms ON time and 5~10 ms opposite polarity time.

The voltage level may be DC pulse of 0.8~1.2V or 0.8~1.2 positive voltage and −0.8~−1.2 negative voltage.

The current density may be, e.g., a positive pulse of about 10 mA per square cm or an alternating pulse of positive 10 mA per square cm and negative 2 mA per square cm.

By supplying the electrolytic solution onto the surface to be machined and applying the voltage from the electrolytic power supply between the electrode plate 23 and the surface to be machined as described above, the surface to be machined, e.g., a copper film having projections and hollows on the surface is electrically machined to reduce surface irregularity or smoothing the surface by the above mentioned mechanism.

The electrolytic current value affects the quality of the electrical machining and depends on the applied voltage and the electric resistance between the electrode plate 23 and the surface to be machined. Accordingly, the distance d between the electrode plate 23 and the surface to be machined is preferably adjusted to the range, e.g., several mm to tens of mm. In this particular embodiment, it is essentially determined by the thickness of the wiper 24.

The electrolytic power supply 61 may be provided with a current meter 62 as current detection means according to the present invention. The current meter enables to monitor the electrolytic current of the electrolytic power supply 61 and supplies the monitored current signal 62*s* to a controller 55. It is also possible that the electrolytic power supply 61 is provided with a resistance meter as resistance detection means to replace the current detection means. The function of the resistance detection means is the same as the current detection means.

The controller 55 controls the entire operation of the electro-chemical machining apparatus. That is, the controller 55 supplies a control signal 52*s* to a main shaft driver 52 for controlling the number of revolutions of the electro-chemical machining tool 11, a control signal 51*s* to the Z-axis driver 51 for position controlling in the Z-axis direction of the electro-chemical machining tool 11, a control signal 53*s* to a table driver 53 for controlling the number of revolutions of the wafer W and a control signal 54*s* to an X-axis driver 54 for controlling the speed of the wafer W in the X-axis direction. Also, the controller 55 controls the operation of an electrolytic solution supplying apparatus 81 and a slurry control apparatus 71 for controlling the operation of supplying the electrolytic solution EL and the slurry SL to the machining head portion.

Also, the controller 55 is constructed to control the output voltage as well as frequency and pulse width of the output pulse from the electrolytic power supply 61. The controller 55 receives the current signal 62*s* from the current meter 62 in the electrolytic power supply 61 for controlling the operation of the electro-chemical machining apparatus in response to the current signal 62*s*. That is, the controller 55 controls to maintain the electrolytic current from which the current signal 62*s* is derived by feeding back the current signal 62*s* to the Z-axis servo motor 31 and to stop the electro-chemical machining operation of the electro-chemical machining apparatus based on the current value as defined by the current signal 62*s*.

It is possible to apply a repetitive pulse so that the current flowing through the cathode member and the metal film varies in a step manner.

For example, the repetitive pulse flowing through the cathode member and the metal film is set to gradually increase in an initial stage of removing the metal film. This effectively prevents degradation of the surface condition of the metal film to be removed by instantly applying high voltage at the start of applying voltage. Since the current signal 62*s* decreases near the final stage of removing the metal film, the current signal 62*s* is compared with a predetermined threshold level to decrease the output pulse in the final stage. Subsequently, a control signal is applied to the electrolytic power supply 61 to terminate the output pulse.

The control panel 56 connected to the controller 55 is used for entering data by an operator or displaying, e.g., the monitored current signal 62*s*.

Figure 15:
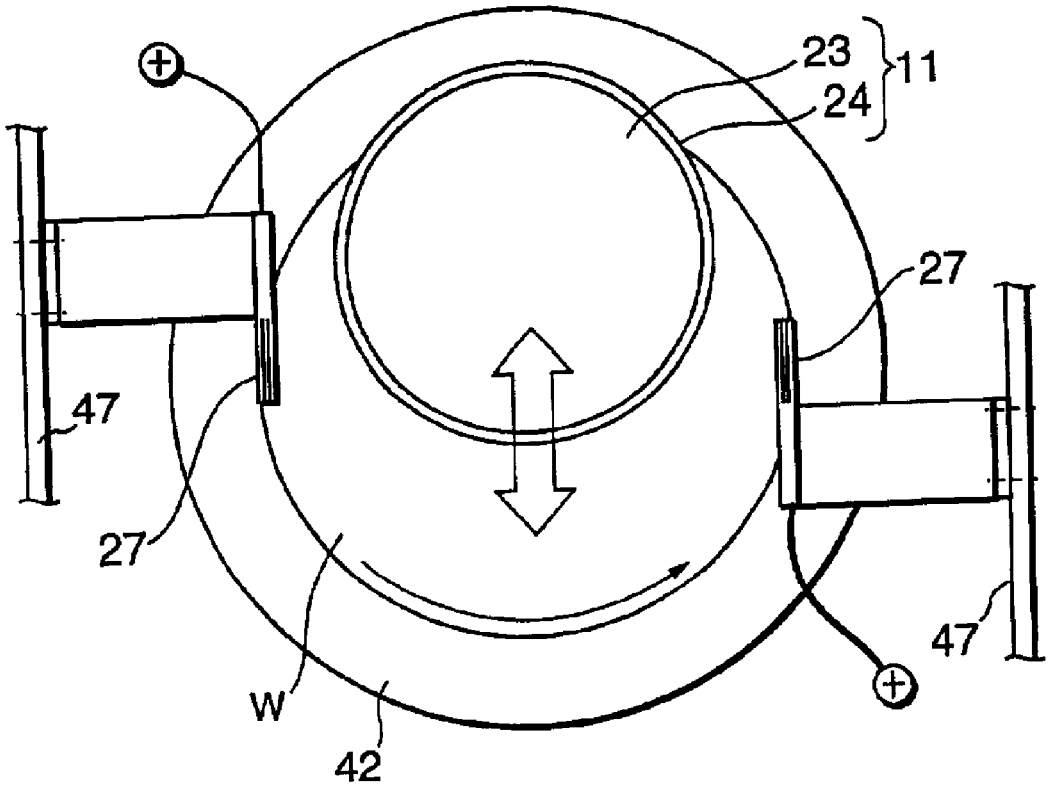
FIG. 15 is a top plan view showing a schematic layout of the electro-chemical machining tool, a wafer, a connection brush, etc, according to the first preferred embodiment of the present invention.

Next, a layout of the electro-chemical machining tool and the electrically conductive brush will be described below. FIG. 15 is a top view illustrating the layout of the electro-chemical machining tool and the electrically conductive brush according to a preferred embodiment of the present invention. Mounted on the wafer table 42 is the wafer W which is driven to rotate with the surface to be machined facing upwardly. The electro-chemical machining tool 11 comprising the electrode plate 23 and the wiper 24 is made to contact the electro-chemical machining surface of the wafer W with a certain pressure in such a manner to rotate at a certain speed, e.g., 100 rpm (rotation per minute) and also reciprocally moving in one direction at a speed of, e.g., 30 m/s.

One or a plurality of electrically conductive brush 27 connected to the plus electrode of the electrolytic power supply 61 is mounted on a wall of the electrolytic solution reservoir 47 as a removable cartridge comprising, e.g., support portions 28*a*, 28*b*, 28*c* in such a manner to make a contact with an outer peripheral portion of the surface to be machined of the wafer W.

The cartridge is movable by an arm portion (not shown) and is adjustable in position with respect to the peripheral portion of the wafer.

Figure 16A:
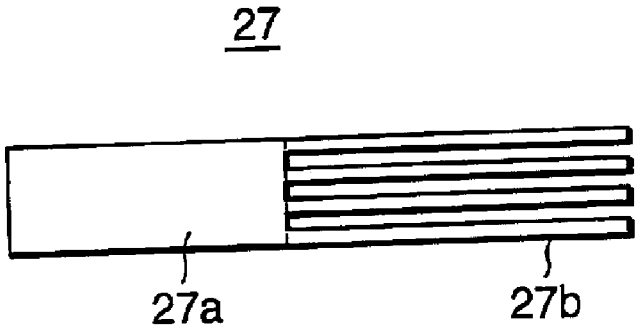
FIG. 16A is a top schematic view of a connection brush.
Figure 16B:
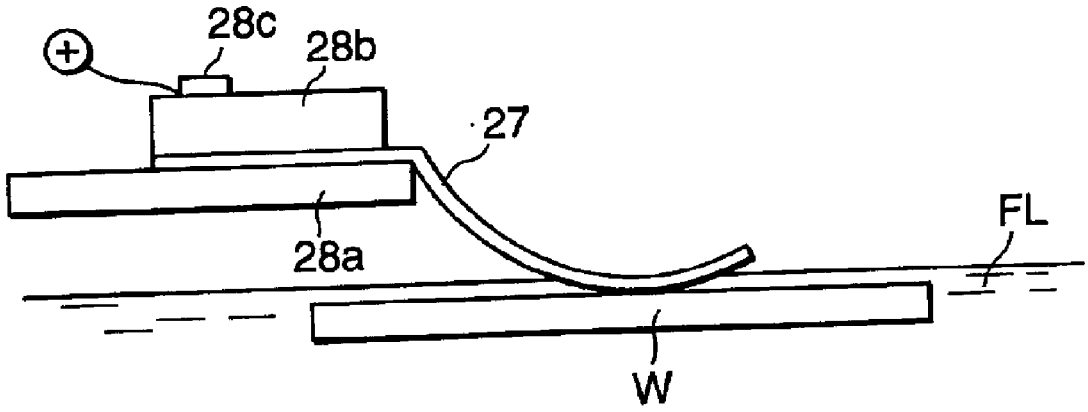
FIG. 16B is a schematic side view of the brush mounted on the electro-chemical machining apparatus, according to a preferred embodiment of the present invention.

Illustrated in FIG. 16A is a schematic top view of the electrically conductive brush and FIG. 16B is a schematic side view of the electrically conductive brush to show how it is mounted to the apparatus. The electrically conductive brush 27 comprises a flat plate-like base 27*a* and a contact portion 27*b* bent in a curve. The boundary of the base 27*a* and the contact portion 27*b* is bent in the direction opposite to that of the contact portion 27*b* to provide a so-called torsion plate. The electrically conductive brush 27 is made from such material, e.g., copper, nickel or the like not soluble to the electrolytic solution and plated with platinum at the contact portion 27*b*. Alternatively, the electrically conductive brush 27 may be made entirely from platinum.

In the electro-chemical machining tool according to the preferred embodiment of the present invention, the electrolytic solution is supplied from the electrolytic solution supply means onto the surface to be machined of an object to be machined having a metal film of copper or the like. Also, electric current is made flown from the power supply through the electrode plate 23 and the metal surface to be machined for anode oxidation to ionize or chelating by chelating reaction with chelating agent. The metal film weakened by anode oxidation can be removed by wiping of the wiper. This means that any steps on the metal film surface of the object to be machined can be efficiently reduced to provide a smooth surface by the electro-chemical machining with low pressure.

This is advantageous in reducing scratches, easing steps as well as reducing dishing and erosion as compared to a simple machine polishing. This is, therefore, very useful in case of machining such objects to be machined as having an organic low dielectric constant film or a porous low dielectric constant insulation film as the interlayer insulation film.

(Second Embodiment)

Figure 17A:
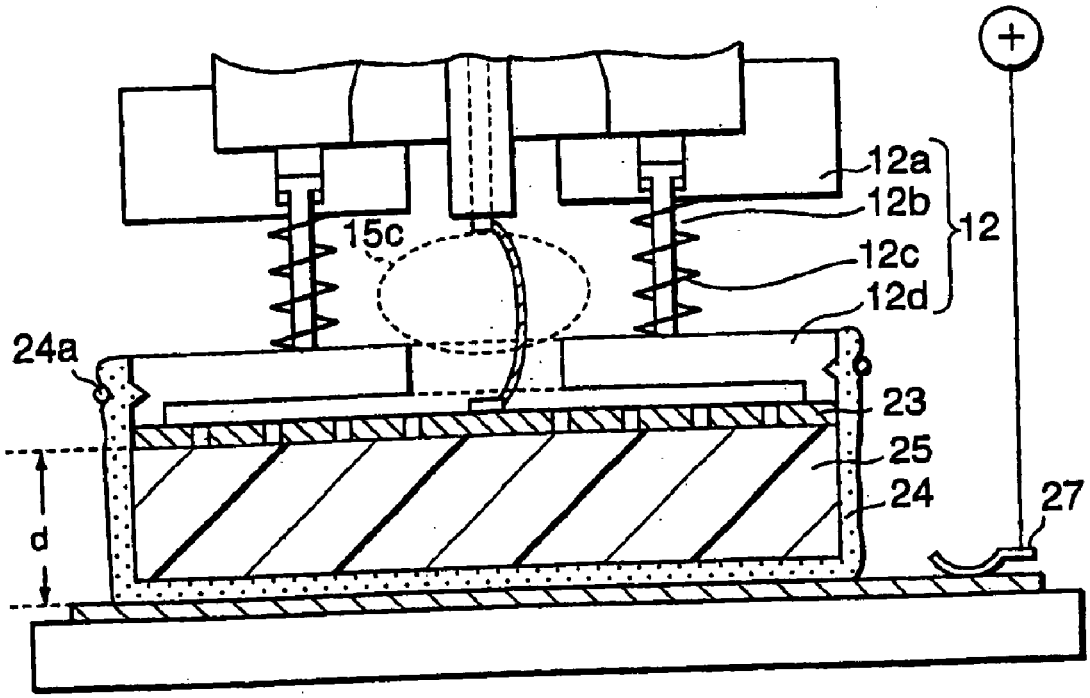
FIG. 17A is a schematic diagram illustrating a portion of a electro-chemical machining apparatus according to a second preferred embodiment of the present invention and FIG. 17B is a schematic perspective view of the spacer 25, according to the second preferred embodiment of the present invention.

Illustrated in FIG. 17A is a schematic construction of a main part or portion of the electro-chemical machining apparatus according to the second preferred embodiment of the present invention. The electro-chemical machining apparatus of the second preferred embodiment has essentially a construction which is similar as that of the first preferred embodiment but differs in the provision of a spacer 25 at the machining surface side of the electrode plate 23 acting as the cathode.

Figure 17B:
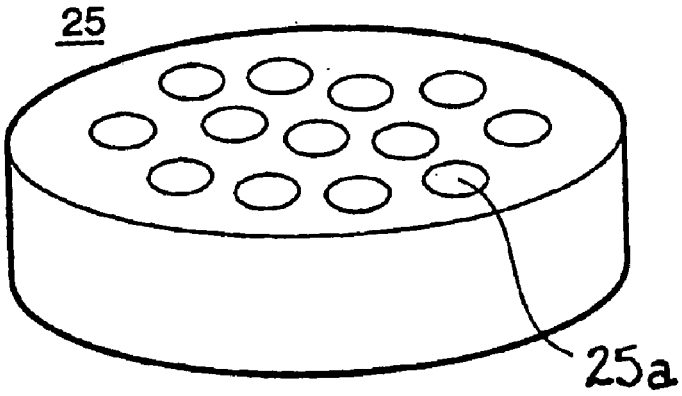

FIG. 17B is a schematic perspective view of the spacer 25 which may comprise a columnar base formed with through-holes 25*a* for passing the electrolytic solution. In the electro-chemical machining apparatus in this embodiment, the thickness of the spacer 25 is varied in the range of, e.g., several mm to tens of mm to control the distance between the electrode 23 and the surface to be machined of the wafer W In this way, the electrolytic current is adjusted to improve the quality of the electro-chemical machining. The second embodiment might enjoy all of the advantages of the first embodiment.

(Third Embodiment)

Figure 18A:
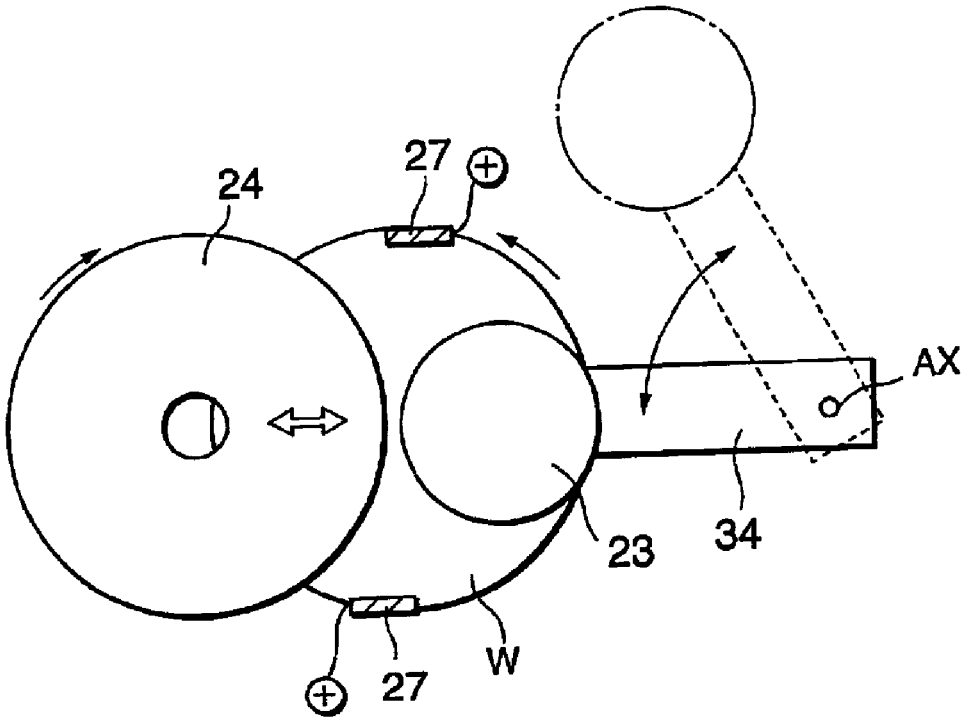
FIG. 18A is a schematic top view illustrating the layout of feature parts of an electro-chemical machining apparatus according to a third preferred embodiment of the present invention and FIG. 18B is a schematic side view corresponding to FIG. 18A.
Figure 18B:
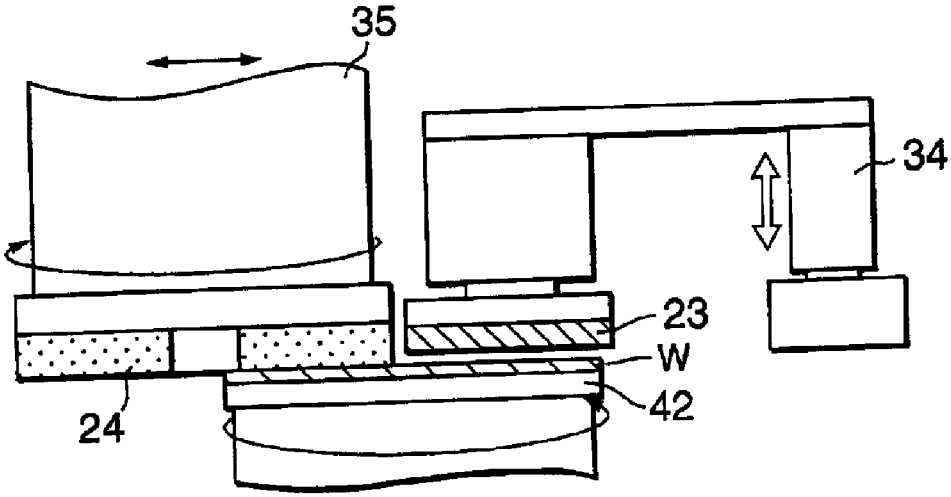

Illustrated in FIG. 18A is a schematic top view of the wafer, the electrode plate acting as the cathode and a wiper, which are main parts of the electro-chemical machining apparatus of a third preferred embodiment of the present invention. FIG. 18B is a schematic side view corresponding to FIG. 18A.

Unlike the first and second embodiments, the electro-chemical machining apparatus according to the third preferred embodiment has the electrode plate and the wiper separated from each other. That is, the wafer W is mounted on a rotary wafer table 42 driven to rotate with the surface to be machined facing upwardly. The electrode plate 23 acting as the cathode supported by an electrode support 34 and the wiper 24 supported by a wiper support 35 are disposed in opposite relationship to the surface to be machined of the wafer W.

In other words, the electrode support 34 rotatably holds the electrode plate 23 in such a manner to rotate the electrode plate 23 about the support axis AX. When the electrode plate 23 is moved above the wafer W from the retracted position, the portion of the support axis AX moves downwardly to adjust the distance between the electrode plate 23 and the surface to be machined of the wafer W, thereby maintaining a non-contacting relationship.

It is not required that the electrode plate 23 be rotatable.

On the other hand, the wiper 35 rotatably supports the wiper 24 and reciprocally moves in one direction while applying a given pressure onto the surface to be machined. The wiper support 35 is essentially the same construction as the electro-chemical machining tool holder portion of the first preferred embodiment. The reciprocal movement of the wiper 24 is in synchronism with the rotary movement of the electrode plate 23. In the retracted position of the electrode 23, the wiper 24 moves to the right position in the drawing toward the center of the wafer W When the wiper 24 is moved to the left position in the drawing to shift from the center of the wafer W, the electrode plate 23 makes a rotary movement with the maximum overlapping area with the wafer W Also, one or more electrically conductive brush 27 connected to the plus electrode of the electrolytic power supply is provided in such a manner to make contact with the outer edge of the surface to be machined of the wafer W.

In the above mentioned preferred embodiment of the electro-chemical machining apparatus, the electrolytic solution is supplied onto the surface to be machined of the wafer W and a desired voltage is applied from the power supply between the electrode plate 23 and the surface to be machined of the wafer W, electrolytic reaction takes place on the surface to be machined opposite to the electrode 23. Since the wafer W is rotating, the portion where the electrolytic reaction takes place rotates and enters the zone opposite to the wiper 24 to be wiped off. In this manner, the surface to be machined of the wafer W will be electrically machined.

According to the electro-chemical machining apparatus of this preferred embodiment, the electrode plate acting as the cathode and the wiper are separately disposed, thereby enabling to set their locations, pressure, the distance to the surface to be machined, the revolution speed and the like to any desired value so that the electrode plate and the wiper meet preferable conditions.

As a result, the electrode plate and the wiper can be set to improve the quality of the electro-chemical machining.

This embodiment is effective to such applications that the surface to be machined is preferably wiped some time after the electrolytic reaction. Wiping speed or rate can be adjusted by, e.g., controlling the number of revolutions of the wafer.

This embodiment also might enjoy all advantages of the first preferred embodiment of the present invention.

(Fourth Embodiment)

Figure 19A:
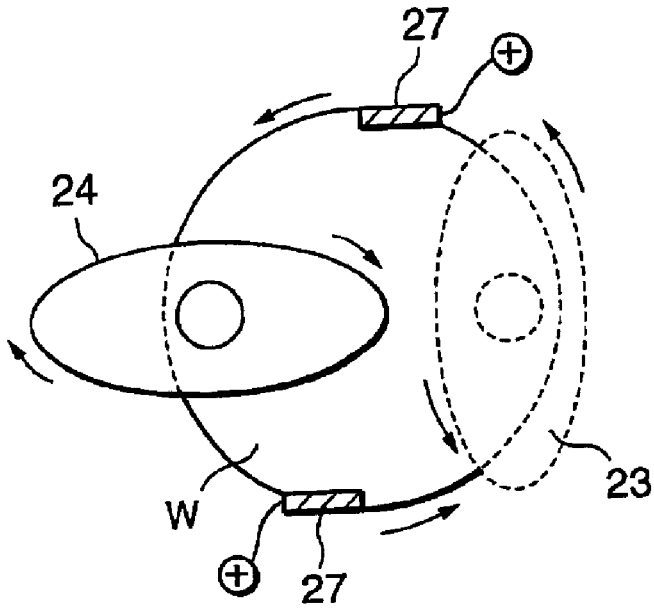
FIG. 19A is a schematic top view illustrating the layout of feature parts of an electro-chemical machining apparatus according to a fourth preferred embodiment of the present invention and FIG. 19B is a schematic side view corresponding to FIG. 19A.
Figure 19B:
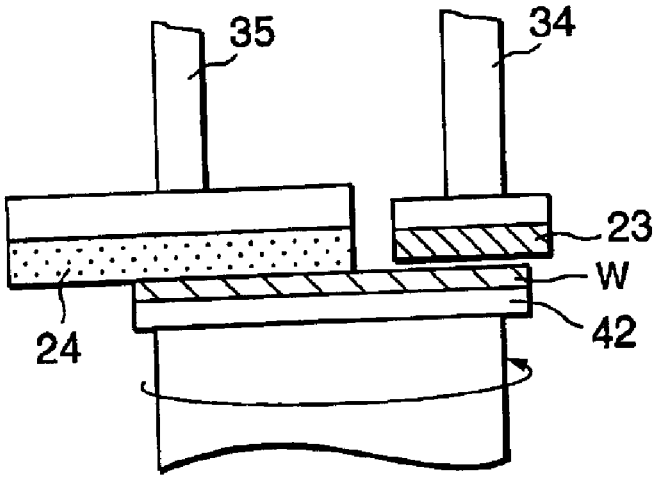

FIG. 19A is a top view illustrating a layout of the wafer, the electrode plate functioning as the cathode, and the wiper as constitutive portions of the electro-chemical machining apparatus according to a fourth embodiment of the present invention. FIG. 19B is a side view corresponding to FIG. 19A.

This embodiment has essentially the same construction as the third preferred embodiment but the electrode plate 23 having a function as the cathode, and the wiper 24 have an elliptical shape. They are constructed to rotate in opposedirections to each other so that their longer axes do not touch.

In this embodiment, the entire surface of the wafer W can be machined without the need for retraction of the electrode plate 23 and reciprocating movement of the wiper 24.

(Fifth Embodiment)

Figure 20A:
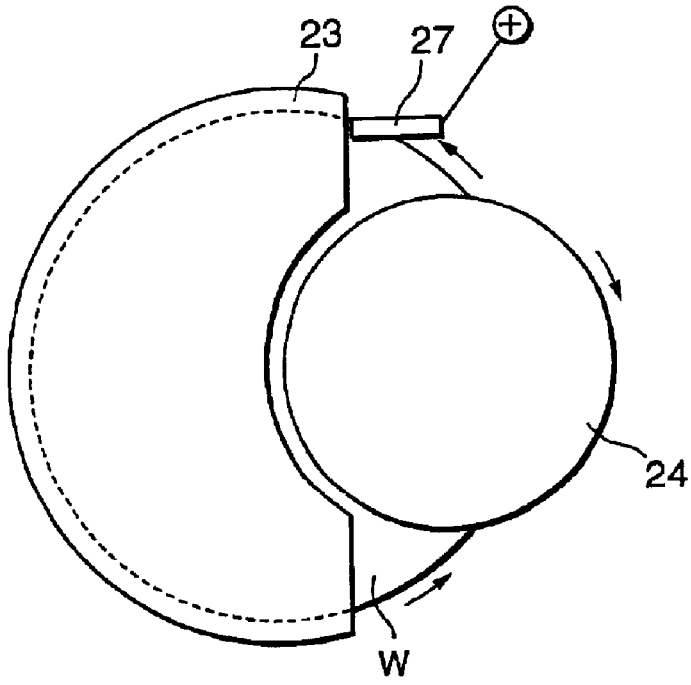
FIG. 20A is a schematic top view illustrating the layout of feature parts of an electro-chemical machining apparatus according to a fifth preferred embodiment of the present invention and FIG. 20B is a schematic side view corresponding to FIG. 20A.
Figure 20B:
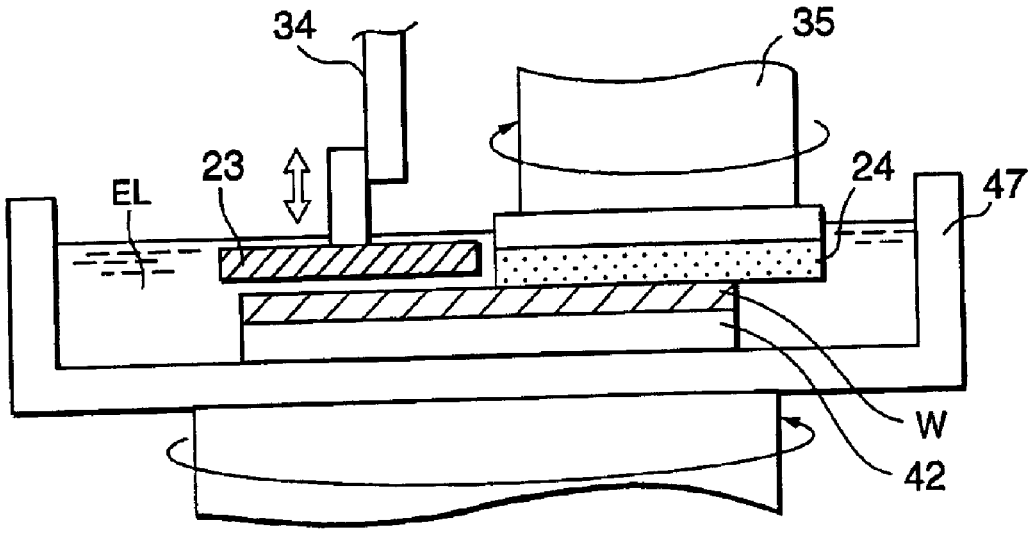

FIG. 20A is a top view illustrating a layout of the wafer, the electrode plate functioning as the cathode, and the wiper as feature portions an the electro-chemical machining apparatus according to a fifth preferred embodiment of the present invention. FIG. 20B is a side view corresponding to FIG. 20A.

The electro-chemical machining apparatus according to the fifth preferred embodiment includes the electrode plate functioning as the cathode and the wiper, which are separated from each other similarly to the third preferred embodiment but with a difference in which the cathode is fixed instead of being rotary driven.

The electrode plate 23 is approximately crescent-moon-shaped (or substantially semicircular having a recessed portion at one part of the chord) so as to cover one peripheral part of the surface to be machined. However, the electrode plate 23 can be moved up and down in the drawing so as to adjust distance from the surface to be machined.

Further, the recessed portion in the outline of the crescent-moon-shaped electrode plate 23 is adapted to the outer peripheral portion of the circular wiper 24.

In this embodiment, movement of the electrode plate 23 and the wiper 24 are not required for the electro-chemical machining of the entire surface of the wafer W.

Other structures including the electrically conductive brush 27 contacting the outer periphery of the surface of the wafer W to be machined are similar to the third preferred embodiment of the invention.

According to the electro-chemical machining apparatus in this embodiment, the fixed electrode plate 23 functioning as the cathode makes it possible to set the diameter larger than that of the wafer W. This avoids any remaining non-machined area at the periphery of the wafer W outside the electrode plate 23 that is smaller than the wafer W.

Wiper 24 and the wiper support 35 may have the same construction as those in the third preferred embodiment of the present invention. The electrode plate 23 and the electrically conductive brush 27 respectively functioning as the cathode and the anode as well as the wiper 24 are held in the electrolytic solution EL stored in the electrolytic solution reservoir 47. The electrical current flows from the electrically conductive brush 27 to the electrode plate 23 or the cathode through the wafer W and the electrolytic solution EL.

Although the cathode electrode is fixed, the wiper 24, the wiper support 35 and the wafer W rotate independently for performing electro-chemical machining of the surface of the wafer W to be machined.

In the electro-chemical machining apparatus of this particular preferred embodiment, the electrode plate as the cathode and the wiper are separated so that their relative position, pressure, distance from the surface to be machined, and the revolution speed can be set so as to satisfy preferable requirements of the electrode plate and the wiper.

This means that the electrode and the wiper can be adjusted for improving the electro-chemical machining.

Also, this embodiment is particularly useful for such applications that wiping should be performed preferably some time after electrolytic reaction by controlling, e.g. the number of revolution of the wafer to adjust the electrolytic removing speed or rate.

In addition, this preferred embodiment might enjoy all advantages of the first preferred embodiment, already described above.

(Sixth Embodiment)

Figure 21A:
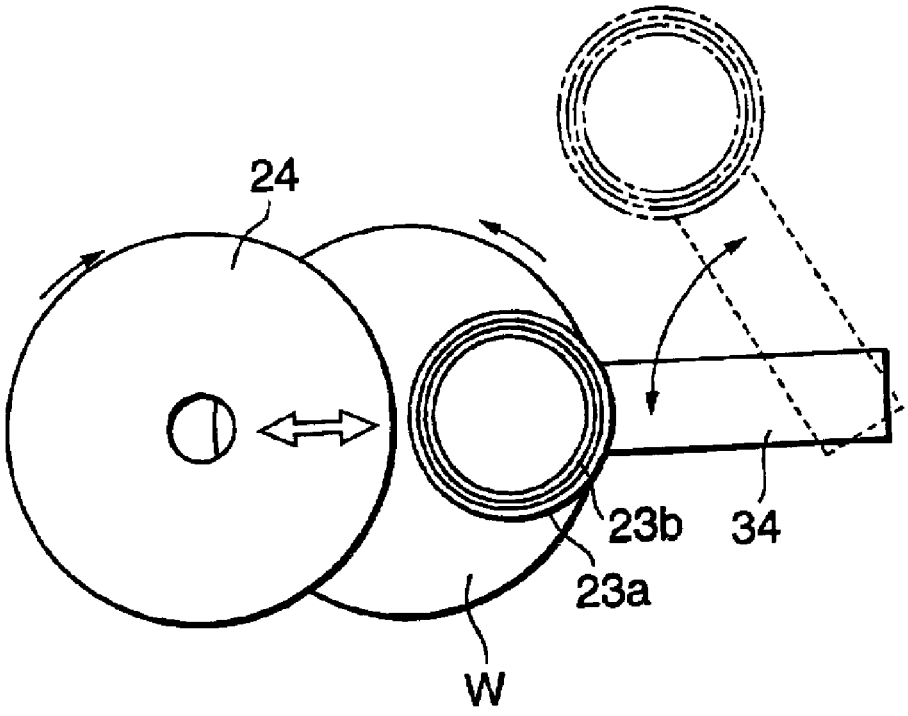
FIG. 21A is a schematic top view illustrating the layout of feature parts of an electro-chemical machining apparatus according to a sixth preferred embodiment of the present invention and FIG. 21B is a schematic side view corresponding to FIG. 21A.
Figure 21B:
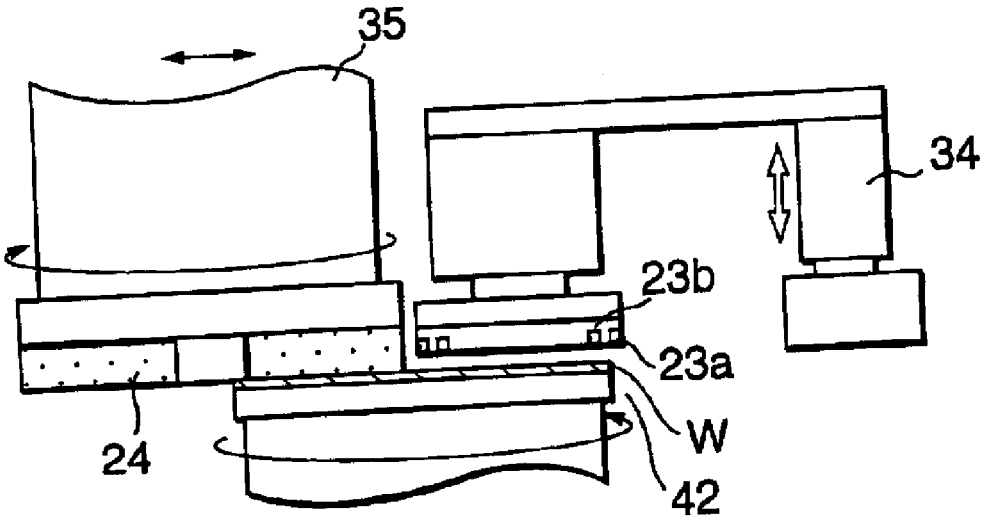

FIG. 21A is a top view of a feature portion of the electro-chemical machining apparatus of a sixth preferred embodiment of the present invention, illustrating a layout of the wafer, both cathode and anode electrodes and the wiper. FIG. 21B is a side view corresponding to FIG. 21A.

This preferred embodiment has essentially similar construction to that of the third preferred embodiment, however differing in the following points. The electrode to be disposed in an opposite relationship with the surface of the wafer W to be machined is separated in two concentric rings, or a relatively larger outer electrode 23*a* acting as the anode and a relatively smaller inner electrode 23*b* acting as the cathode, thereby eliminating a contact electrode such as the electrically conductive brush. Both anode electrode 23*a* and the cathode electrode 23*b* are disposed in a non-contacting relationship to the surface to be machined. The other portions are the similar to the third preferred embodiment.

Figure 22:
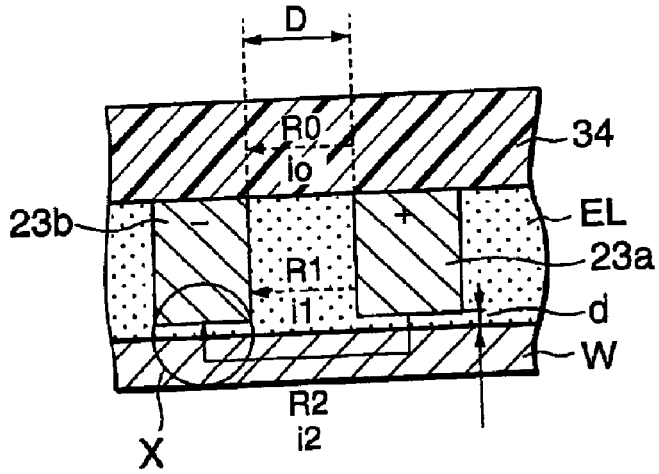
FIG. 22 is a schematic diagram illustrating a geometry of a wafer and an electrode of the electro-chemical machining apparatus according the sixth preferred embodiment of the present invention.

Now, a feature description will be made on the electric current conduction of the above preferred embodiment when both cathode electrode 23*a* and the anode electrode 23*b* are disposed in a non-contacting relationship. FIG. 22 illustrates a positional relationship between the wafer W and the two electrodes (23*a* and 23*b*). Both electrodes (23*a* and 23*b*) are mounted on an insulation support 34*a* and the gap between the insulation support 34*a* and the wafer W are filled with electrolytic solution EL on an area in the vicinities of the electrodes (23*a* and 23*b*).

In the above mentioned example, a voltage is applied between the anode electrode 23*a* and the cathode electrode 23*b*.

An electric resistance R0 of the insulation support 34*a* is considerably high, thereby there is essentially no current i0 from the anode electrode 23*a* to the cathode electrode 23*b* by way of the insulation support 34*a*. This means that the current from the anode electrode 23*a* to the cathode electrode 23*b* is split into the current i1 flowing through the electrolytic solution EL having electric resistance R1 and the current i2 flowing through the electrolytic solution EL, the surface area of the wafer W and again the electrolytic solution EL.

It is to be noted that the electric resistance R1 in the electrolytic solution EL is proportional to a distance D between the anode electrode 23*a* and the cathode electrode 23*b*. On the other hand, the electric resistance R2 of the current path flowing the surface area of the wafer W is proportional to a distance d between the wafer W and the electrodes (23*a* and 23*b*). By choosing a distance sufficiently larger than the distance d between the wafer W and the electrodes (23*a* and 23*b*), the current i1 flowing directly through the electric resistance R1 in the electrolytic solution EL is considerably small while the current i2 is considerably large, thereby most of the electrolytic current flows essentially through the surface area of the wafer W.

When the current flows through the surface area of the wafer W as mentioned above, the metal film such as copper film on the surface of the wafer W is anode oxidized by the electrolytic reaction of the electrolytic solution EL. The metal film is ionized or reacted with chelating agent in the electrolytic solution, thereby weakening to be easily wiped off by the wiper.

Figure 23:
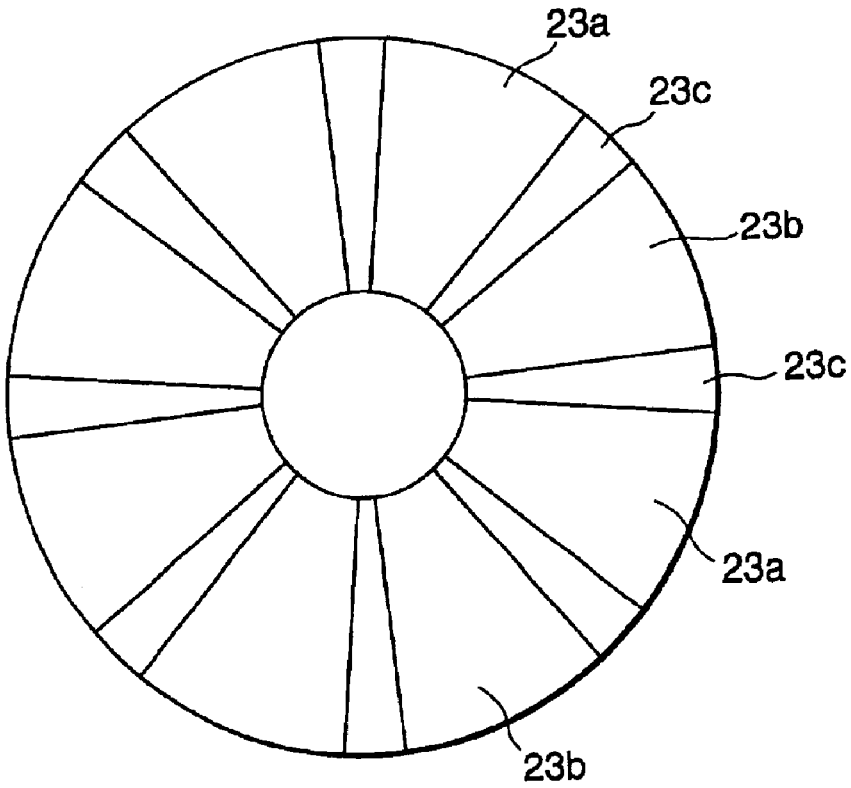
FIG. 23 is a schematic plan view of a plurality of fan-shaped electrodes separated by grooves between adjacent electrodes according to an electro-chemical machining apparatus according a preferred embodiment of the present invention.

The layout of splitting the electrode to be disposed in opposite relationship to the surface to be machined of the wafer W is not limited to the abovementioned concentric ring shape but may be, e.g., a plurality of divided electrodes (23*a* and 23*b*) in fan-shape as illustrated in a plan view in FIG. 23. Adjacent electrodes are separated by a channel 23*c*. The anode electrodes 23*a* and the cathode electrodes 23*b* are disposed alternately. As long as the plurality of electrodes are disposed in opposite position to the surface to be machined on the wafer W not to contact the surface, they may be used either anode or cathode. It is also possible to use all of the divided electrodes as the cathode. However, a contacting anode electrode will be provided in this case.

In the electro-chemical machining apparatus in this particular preferred embodiment, the electrodes and the wiper are separately disposed so that position, pressure, distance from the surface to be machined and revolution speed may be set to satisfy preferable requirements of the electrodes and the wiper. This means that the electrode plate and the wiper are set to improve quality of the electro-chemical machining.

Also, it is possible to adjust, e.g., the number of revolution of the wafer to control the electrolytic removing rate in such applications that wiping should be performed some time after electrolytic reaction.

In addition, this particular embodiment might enjoys the advantages of the first preferred embodiment.

(Seventh Embodiment)

Figure 24A:
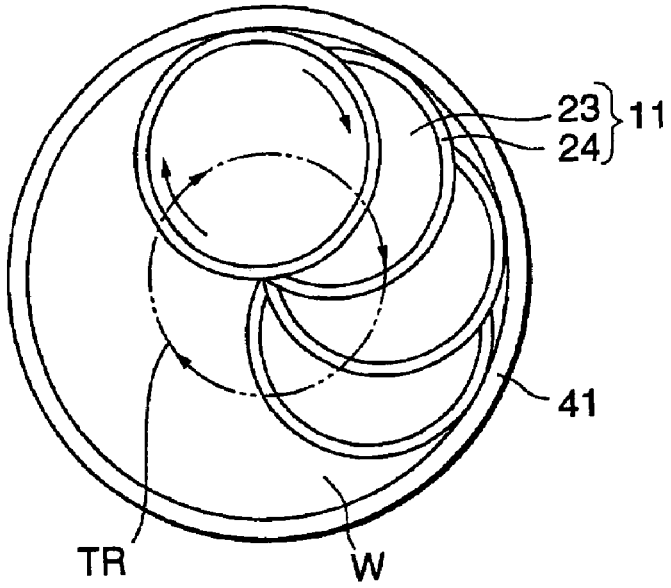
FIG. 24A is a schematic top view illustrating the layout of feature parts of an electro-chemical machining apparatus according to a seventh preferred embodiment of the present invention.
Figure 24B:
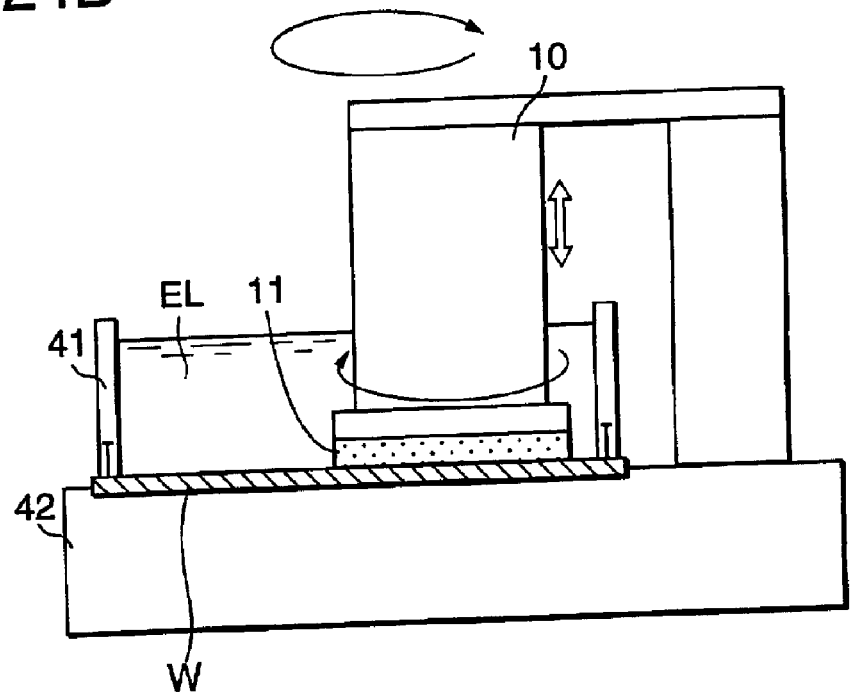
FIG. 24B is a schematic side view corresponding to FIG. 24A

FIG. 24A is a top view of a feature portion of a seventh preferred embodiment of the electro-chemical machining apparatus of the present invention and illustrates the layout of the wafer, the cathode electrode and the wiper. FIG. 24B is a side view corresponding to FIG. 24A.

The seventh embodiment has essentially a similar construction to the first preferred embodiment however differing in that the wafer W is mounted on the wafer table 42 with the surface to be machined facing upwardly and that the electro-chemical machining tool 11 comprises the electrode plate 23 held by the electro-chemical machining tool holder 10 and the wiper 24 covering the electrode plate 23.

It is to be noted that a cylindrical chamber member 41 is removably disposed at the periphery of the wafer W The surface to be machined of the wafer W and the chamber member 41 constitute an electrolytic solution chamber in which the electrolytic solution EL is stored.

Figure 24C:
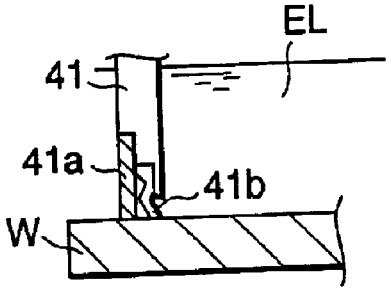
FIG. 24C is a schematic magnified view of the contact portion between the surface to be machined of a wafer and a chamber member, according to the seventh preferred embodiment of the present invention.

FIG. 24C is a magnified partial view of the contacting portion of the surface of the wafer W to be machined and the cylindrical chamber member 41 where an electrode 41*a* contacting the surface to be machined of the wafer W and a seal member 41*b* are disposed. The electrode 41*a* of the chamber member 41 is electrically connected to the plus electrode of the electrolytic power supply 61 to act as the anode.

The seal member 41*b* is in close contact to the surface to be machined so that the electrolytic solution EL does not leak form the chamber 41.

In the above construction, the voltage from the electrolytic power supply is applied to the electrode 41*a* of the chamber member 41 as the anode and the electrode plate 23 of the electro-chemical machining tool 11 as the cathode.

A predetermined pressure is applied to the electro-chemical machining tool 11 by the electro-chemical machining tool holder 10 against the surface to be machined. The electro-chemical machining tool 11 rotates around the main rotary axis of the electro-chemical machining tool holder 10 and revolves on the surface to be machined along the trace TR about the center of the wafer W.

The rotary and revolving speeds of the electro-chemical machining tool 11 are controllable to a desired value by an external controller and are adjusted in response to the electro-chemical machining speed and conditions.

Since the anode electrode is disposed over the entire periphery of the wafer in the seventh preferred embodiment of the electro-chemical machining apparatus, uniform voltage can be applied stably to achieve uniform electro-chemical machining. A spacer can also be installed inside the electro-chemical machining tool in the seventh embodiment similar to the second embodiment for adjusting the distance between the cathode electrode plate and the surface to be machined of the wafer to perform excellent electro-chemical machining.

Also, this particular embodiment may also enjoy the advantages of the first preferred embodiment of the present invention.

(Eighth Embodiment)

Figure 25:
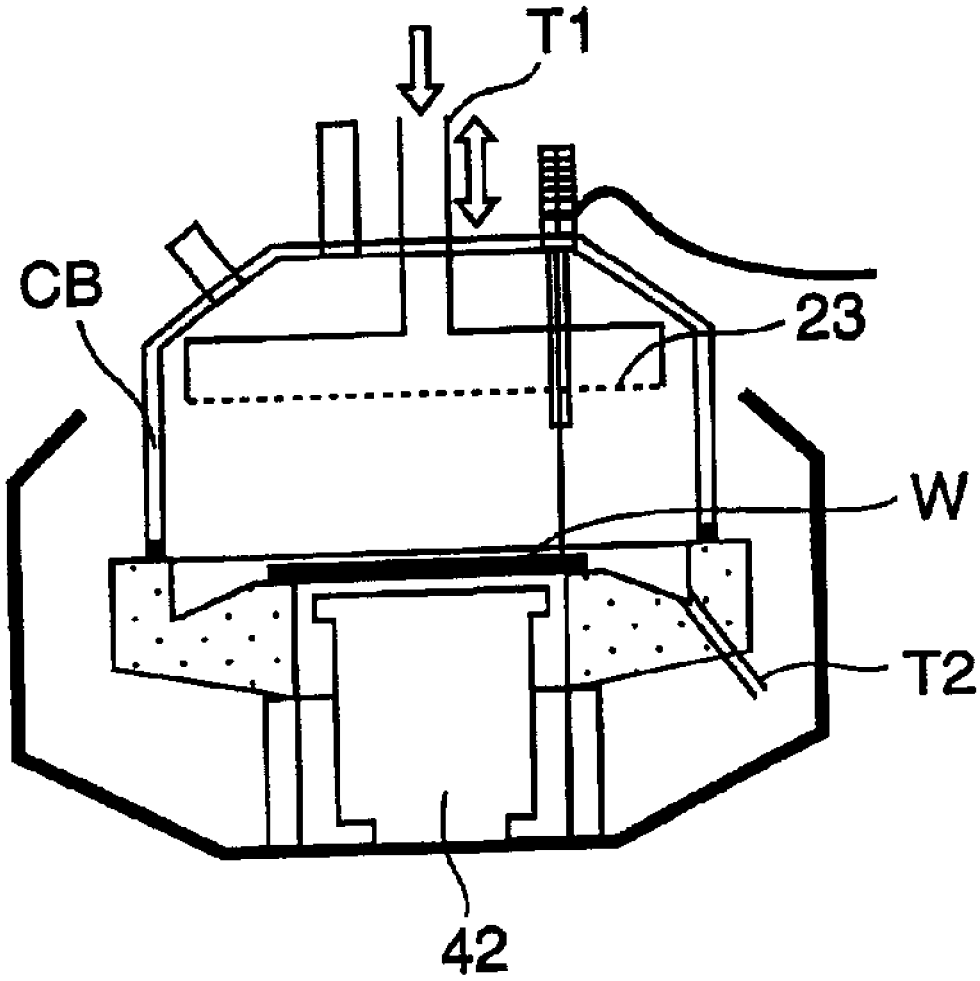
FIG. 25 illustrates a construction of an electro-chemical machining apparatus according to an eighth preferred embodiment of the present invention.

FIG. 25 illustrates the construction of an eighth preferred embodiment of the electro-chemical machining apparatus according to the present invention. This embodiment utilizes a conventional electroplating apparatus for electro-chemical machining purposes by reversing the polarity of the applied voltage. A wafer W to be machined is mounted on an electrolytic removing chamber CB. There are provided an inlet T1 for supplying the electrolytic solution and a uniformly meshed cathode electrode 23 disposed below the inlet T1. Also disposed is an outlet T2 for discharging the supplied electrolytic solution. There is provided a mechanism for moving the cathode electrode 23 up and down (according to an arrow shown in the drawing) along with the inlet T1 for adjusting the distance to the surface to be machined of the wafer W disposed in opposite relationship to the electrode 23.

By rotating the wafer stage 42, the wafer W held thereon is also rotated. An electrical current is made to flow from a plus electrode connected to the surface of the wafer W and a cathode electrode which is tens of mm distant from the wafer W through the electrolytic solution, thereby performing electro-chemical machining of the surface to be machined of the wafer W. This embodiment of the electro-chemical machining apparatus simultaneously performs electro-chemical machining the entire surface of the wafer without the need for wiping the surface to be machined.

(Ninth Embodiment)

Figure 26A:
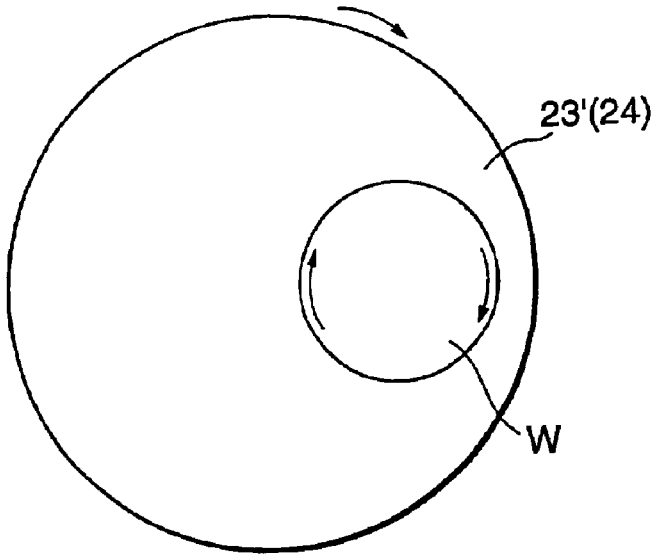
FIG. 26A is a schematic top view illustrating the layout of feature parts of an electro-chemical machining apparatus according to a ninth preferred embodiment of the present invention.
Figure 26B:
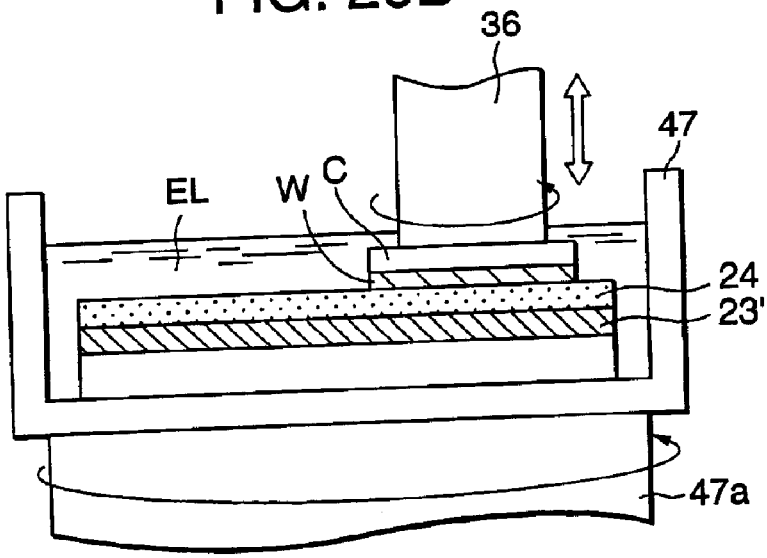
FIG. 26B is a schematic side cross sectional view corresponding to FIG. 26B
Figure 26C:
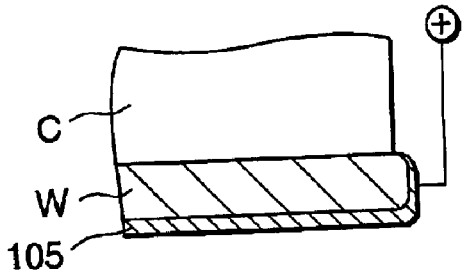
FIG. 26C is a schematic cross sectional view showing a way of supplying electrical current to the wafer, according to the ninth preferred embodiment of the present invention.

FIG. 26A is a top view of a feature portion of a ninth preferred embodiment of the electro-chemical machining apparatus according to the present invention and illustrates the layout of the wafer, cathode electrode and the wiper. FIG. 26B is a side view corresponding to FIG. 26A.

A cathode electrode plate 23' and a wiper 24 having larger diameter than the wafer W to be machined are disposed at the bottom of the electrolytic solution reservoir 47 for storing the electrolytic solution EL. The electrode plate 23' has a meshed surface.

In order to perform electro-chemical machining, the wafer W is held by a chuck C provided with the wafer support 36 and the surface to be machined is urged toward the wiper 24 while applying the voltage between the surface to be machined and the electrode plate 23'.

The wafer W is rotated by the rotation of the wafer support 36 and revolves on the wiper 24 by the rotation of the reservoir holder 47*a* for supporting the electrolytic solution reservoir 47.

The anode electrode plate 23' may be fixed or may be rotated. The cathode electrode 23' is made to move relative to the wafer W.

In the above construction, the surface to be machined of the wafer W is urged toward the wiper 24 in the above construction. In order to connect the anode to the surface to be machined, the wafer side surface is formed to extend outwardly in advance when forming a wiring layer 105 and the like on the surface of the wafer W as illustrated in cross sectional view in FIG. 26C. The anode is connected by way of the extended portion.

Figure 27:
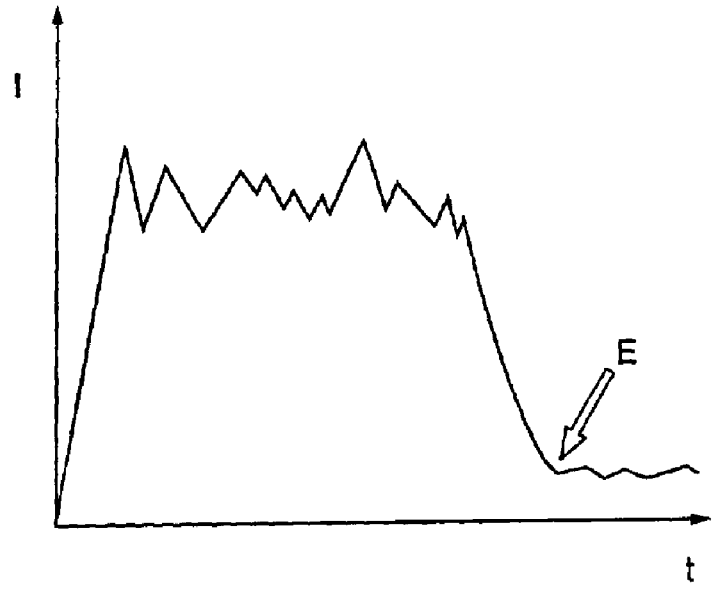
FIG. 27 is a graph showing of electrolytic current against machining time for the electro-chemical machining apparatus, according to the ninth preferred embodiment of the present invention.

FIG. 27 is a graph having the electrolytic current and the machining time of the ninth embodiment of the electro-chemical machining apparatus of the present invention plotted thereon.

At the initiation of the electro-chemical machining, the electrolytic current rises and the metal film such as copper on the surface to be machined is removed. When the underlying metal barrier layer and the insulation layer are exposed, the current decreases suddenly. When the electrolytic current decreases below a predetermined level, it is determined to the end point E, thereby terminating the electro-chemical machining.

According to the ninth embodiment of the electro-chemical machining apparatus according to the present invention, the metal film surface to be machined is anode oxidized and the anode oxidized metal film is wiped off using the wiper in the same manner as the first preferred embodiment. Steps on the metal film surface will be efficiently eased for smoothing the surface at relatively low pressure.

(Tenth Embodiment)

Figure 28:
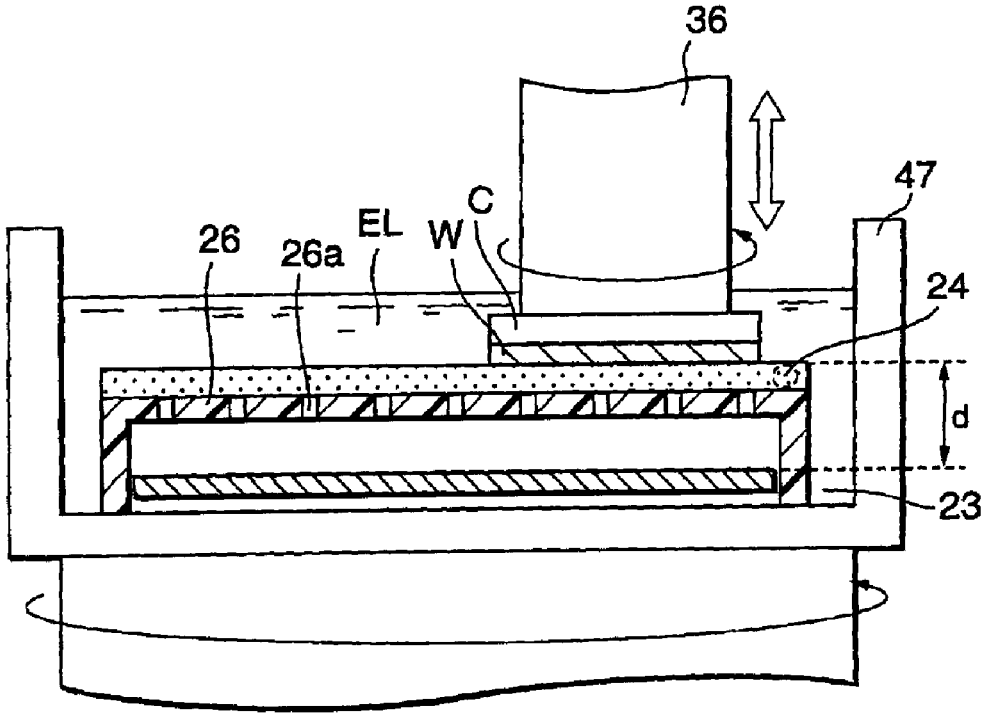
FIG. 28 is a diagram illustrating feature parts of an electro-chemical machining apparatus according to a tenth preferred embodiment of the present invention.

FIG. 28 is a schematic of a feature portion of a tenth preferred embodiment of the electro-chemical machining apparatus according to the present invention. The tenth preferred embodiment has essentially a same construction as the ninth preferred embodiment but differs in that the cathode electrode plate 23 is disposed at the bottom of the electrolytic solution reservoir 47 for storing the electrolytic solution EL and that a cylindrical wiper support table (26) is provided to cover the electrode plate 23 from the above. The wiper 24 is provided on the upper layer. The wiper support table (26) is formed with a plurality of through-holes 26*a* to provide paths for the electrolytic solution EL.

In order to perform electro-chemical machining, the wafer W is held by a chuck C provided with the wafer support 36 and the surface to be machined is urged toward the wiper 24 while a given voltage is applied between the surface to be machined and the electrode plate 23 similar to the ninth embodiment. The wafer W rotates by the rotation of the wafer support 36and revolves on the wiper 24 by the rotation of the reservoir holder 47*a* of the electrolytic solution reservoir 47.

According to the tenth embodiment of the electro-chemical machining apparatus, the height of the wiper support 26 varies the distance between the surface to be machined of the wafer W and the electrode plate 23 in the range of, e.g., several mm to tens of mm, thereby adjusting the electrolytic current value to improve quality of electro-chemical machining. In addition, the tenth embodiment may enjoy the same advantages of the first preferred embodiment.

(Eleventh Embodiment)

Figure 29A:
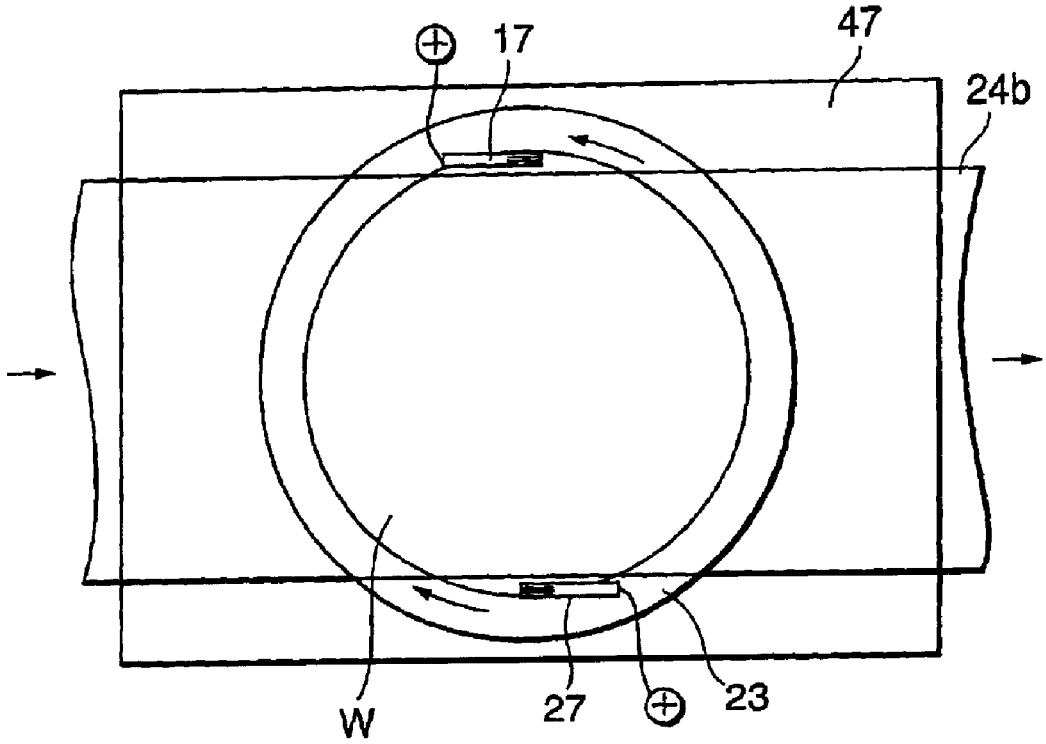
FIG. 29A is a schematic top view illustrating the layout of feature parts of an electro-chemical machining apparatus according to a eleventh preferred embodiment of the present invention and FIG. 29B is a schematic side cross sectional view corresponding to FIG. 29A.
Figure 29B:
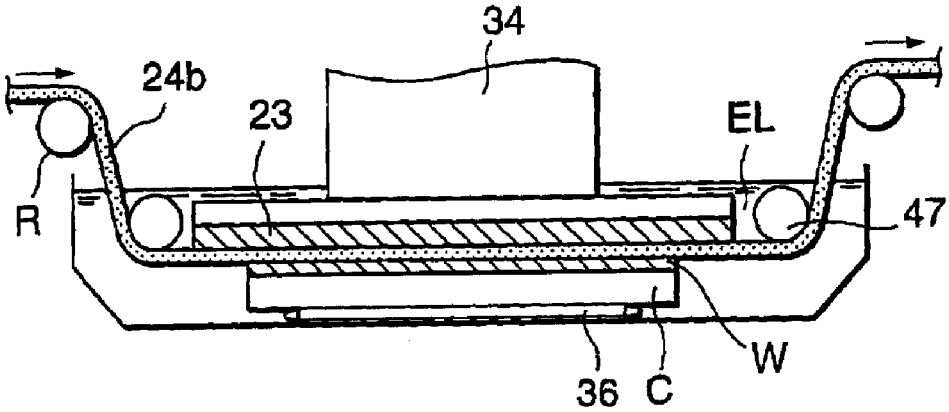

FIG. 29A is a top view of a feature portion of an eleventh preferred embodiment of the electro-chemical machining apparatus according to the present invention and illustrates the layout of the wafer, the cathode electrode plate and the wiper. FIG. 29B is a side cross sectional view corresponding to FIG. 29A. This embodiment differs from the abovementioned first to the tenth preferred embodiments in the use of an elongate belt-like wiper provided with carrying rollers. That is, the wafer W is held by the chuck C of the rotary wafer support 36 at the bottom of the electrolytic solution reservoir 47 for storing the electrolytic solution EL with the surface to be machined facing upwardly.

The belt-like wiper 24*b* is disposed in contact with the surface to be machined of the wafer W and is driven in one direction by the rollers R which rotate about their support shafts. The cathode electrode plate 23 having a larger diameter than the surface to be machined is supported by the rotary electrode support 34 and disposed in opposite relationship to the surface to be machined by way of the belt-like wiper 24*b*. The belt-like wiper 24*b* is chosen to have a shorter width than the diameter of the surface to be machined of the wafer W. The electrically conductive brush 27 functioning as the anode is provided in contact with a peripheral portion of the surface to be machined not covered by the belt-like wiper 24*b*.

For performing electro-chemical machining, the wiper W is driven to rotate while a predetermined voltage is applied between the surface to be machined and the electrode plate 23. The electrode plate 23 is driven to rotate while a pressure is applied to the surface to be machined by way of the belt-like wiper 24*b*, which is driven in one direction by the rollers R. The electrode plate 23 is not required to rotate but may be constructed, e.g., to move back and forth at the location opposite to the surface to be machined by way of the belt-like wiper 24*b*. The belt-like wiper 24*b* may be formed in a roll to enter the electrolytic solution reservoir 47 at a position near and above the surface to be machined of the wafer W and wound at a location outside the electrolytic solution reservoir 47.

Alternatively, both ends of the belt-like wiper 24*b* are jointed together in a loop to be an endless belt which is used inside the electrolytic solution reservoir 47.

Similar to the first preferred embodiment of the present invention, the eleventh preferred embodiment of the electro-chemical machining apparatus efficiently performs electro-chemical machining to ease steps on the metal film surface of an object to be machined or smoothing such surface by anode oxidation of the metal film surface and wiping the anode oxidized metal film surface by a wiper under low pressure.

(Twelfth Embodiment)

Figure 30A:
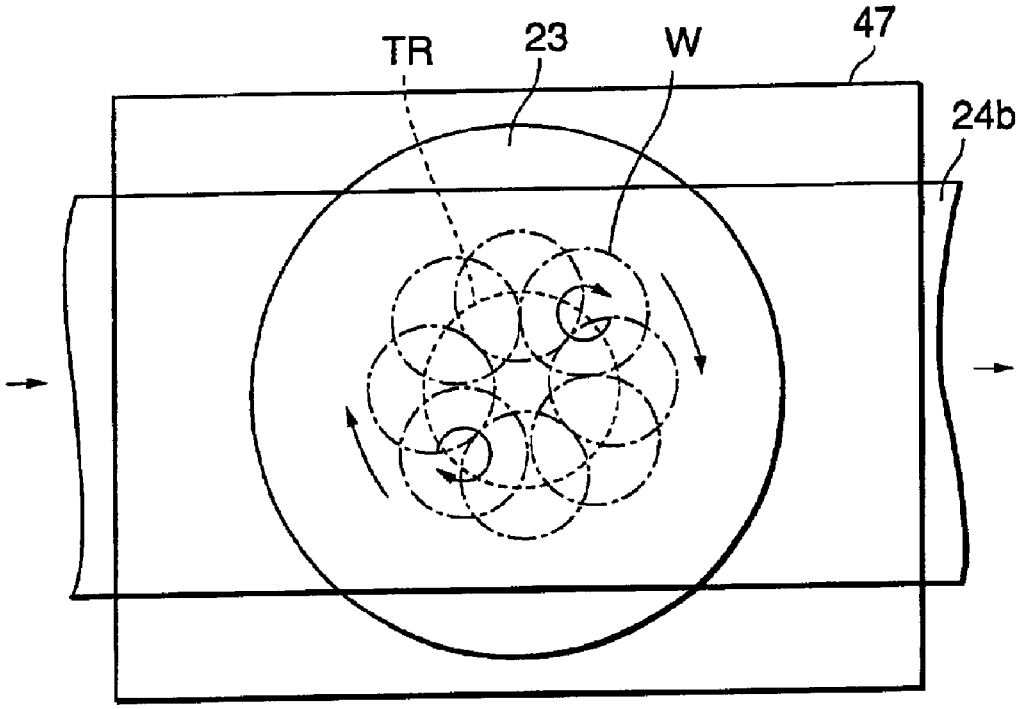
FIG. 30A is a schematic top view illustrating the layout of feature parts of an electro-chemical machining apparatus according to a twelfth preferred embodiment of the present invention and FIG. 30B is a schematic side cross sectional view corresponding to FIG. 30A.
Figure 30B:
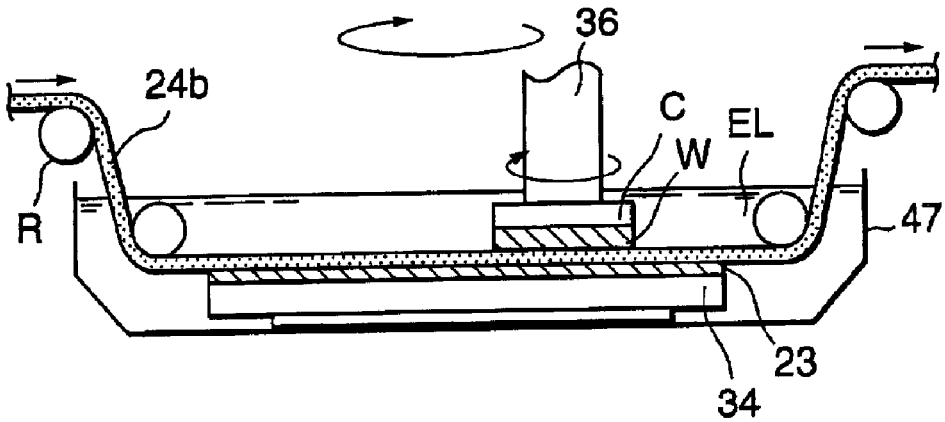

FIG. 30A is a top view of a feature portion of a twelfth preferred embodiment of the electro-chemical machining apparatus according to the present invention and illustrates the layout of the wafer, the cathode electrode plate and the wiper. FIG. 30B is a side cross sectional view corresponding to FIG. 30A. This embodiment is similar to the eleventh preferred embodiment of the electro-chemical machining apparatus in that the wiper is in an elongate belt-shape to be driven by a roller mechanism. However, it differs in that the rotary driven electrode support 34 for supporting the cathode electrode plate 23 is provided in the bottom of the electrolytic solution reservoir 47 storing the electrolytic solution EL and the belt-like wiper 24*b* is disposed on the electrode plate 23 in such a manner to be driven in one direction by rollers R. The wafer W is held by the chuck C of the rotary driven wafer support 36 with the surface to be machined engaging the belt-like wiper 24*b*.

In the twelfth preferred embodiment of the electro-chemical machining apparatus, the entire surface to be machined of the wafer W is pressed against the wiper 24. Similar to the cross sectional view in FIG. 26C for forming a layer to be machined such as the wiring layer 105 on surface of the wafer W, the side surface of the wafer is formed to extend for making the anode connection at the extended portion.

For performing electro-chemical machining using the twelfth embodiment of the electro-chemical machining apparatus, the surface to be machined is pressed at a predetermined pressure by the wafer support. The wafer W is moved so as to revolve on the belt-like wiper 24*b* along the circular trace TR coinciding with the center of the wafer W while rotating by the wafer support 36.

(Variation 1)

Figure 31A:
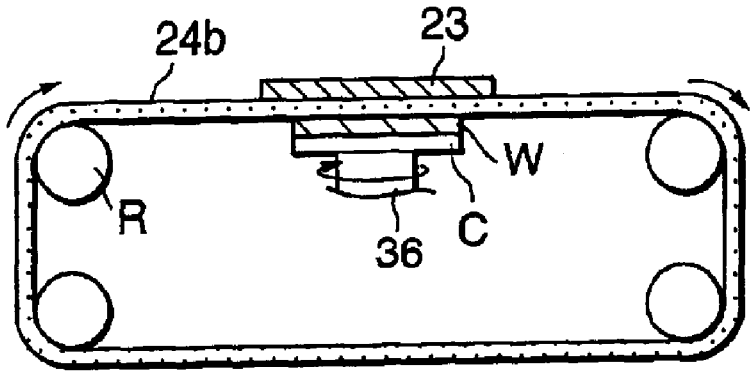
FIG. 31A is a schematic view of first variation of an electro-chemical machining apparatus according to a preferred embodiment of the present invention.

FIG. 31A is a variation in the eleventh preferred embodiment of the electro-chemical machining apparatus. Both ends of the belt-like wiper 24*b* are coupled together in a loop so that it can move within the electro-chemical machining apparatus in an endless manner. The electrolytic solution may be stored in the electrolytic solution reservoir similar to the eleventh preferred embodiment or may be supplied onto the surface to be machined from a supply means such as a dispenser (not shown).

(Variation 2)

Figure 31B:
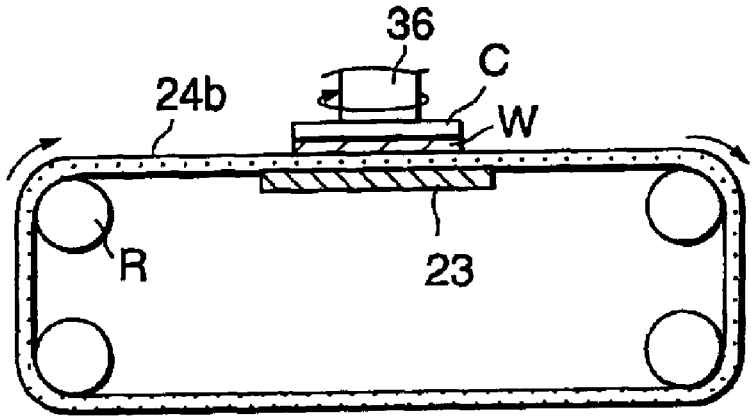
FIG. 31B is a schematic view of second variation of the electro-chemical machining apparatus according to a preferred embodiment of the present invention and FIG. 31C is a schematic view of a third variation of the electro-chemical machining apparatus according to a preferred embodiment of the present invention.

FIG. 31B is a variation of the twelfth preferred embodiment of the electro-chemical machining apparatus. Both ends of the belt-like wiper 24*b* are coupled together in a loop to move within the electro-chemical machining apparatus in an endless manner. The electrolytic solution may be stored in the electrolytic solution reservoir similar to the eleventh embodiment or may be supplied onto the surface to be machined from supply means (not shown) such as a dispenser.

(Variation 3)

Figure 31C:
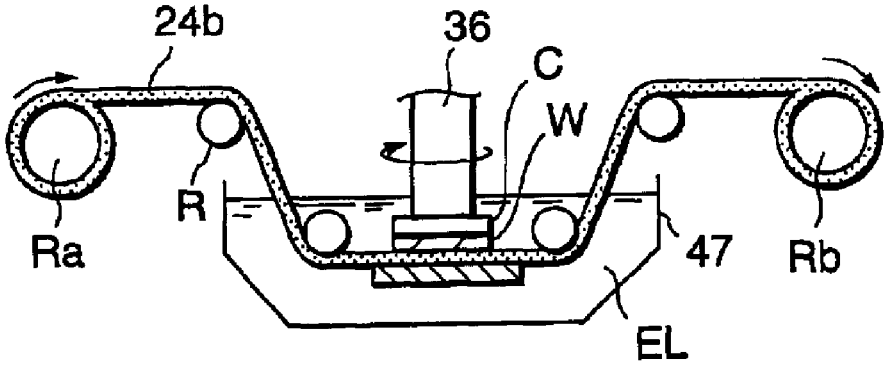

FIG. 31C illustrates a variation of leading one end of the belt-like wiper 24*b* out of the roll Ra disposed near the electrolytic solution reservoir 47 and on the surface to be machined of the wafer W before being rewound around an external roll Rb.

(Variation 4)

Figure 32A:
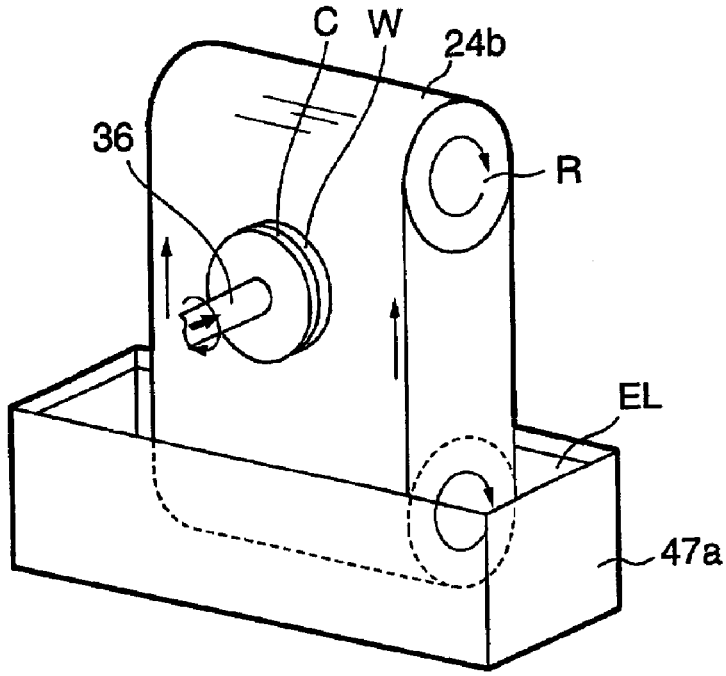
FIG. 32A is a schematic view of a fourth variation of the electro-chemical machining apparatus according to a preferred embodiment of the present invention and FIG. 32B is a schematic view of a fifth variation of the electro-chemical machining apparatus, according to a preferred embodiment of the present invention.

FIG. 32A illustrates a further variation of the above variation 2 in which the surface to be machined of the wafer W is disposed vertically and the belt-like wiper 24*b* is driven in the vertical orientation. The electrolytic solution is absorbed into the wiper when it passes through the electrolytic solution reservoir 47*a* and is supplied onto the surface to be machined of the wafer W.

(Variation 5)

Figure 32B:
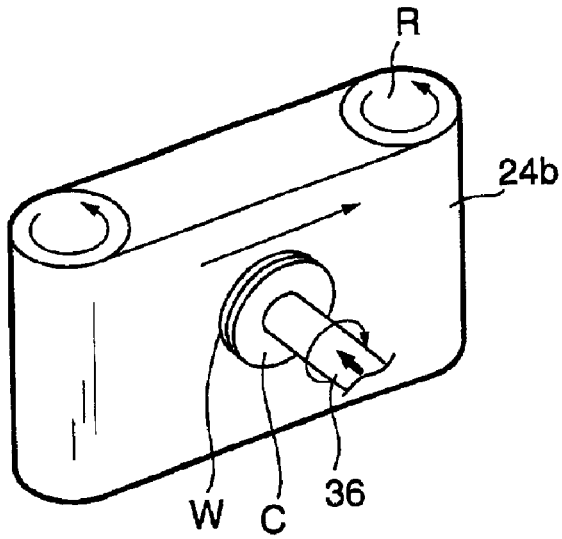

FIG. 32B illustrates still another variation of the variation 2. The wafer W is disposed vertically and the belt-like wiper 24*b* is designed to move horizontally. The electrolytic solution can be supplied onto the surface to be machined from a supply means such as a dispenser (not shown).

(Thirteenth Embodiment)

Figure 33A:
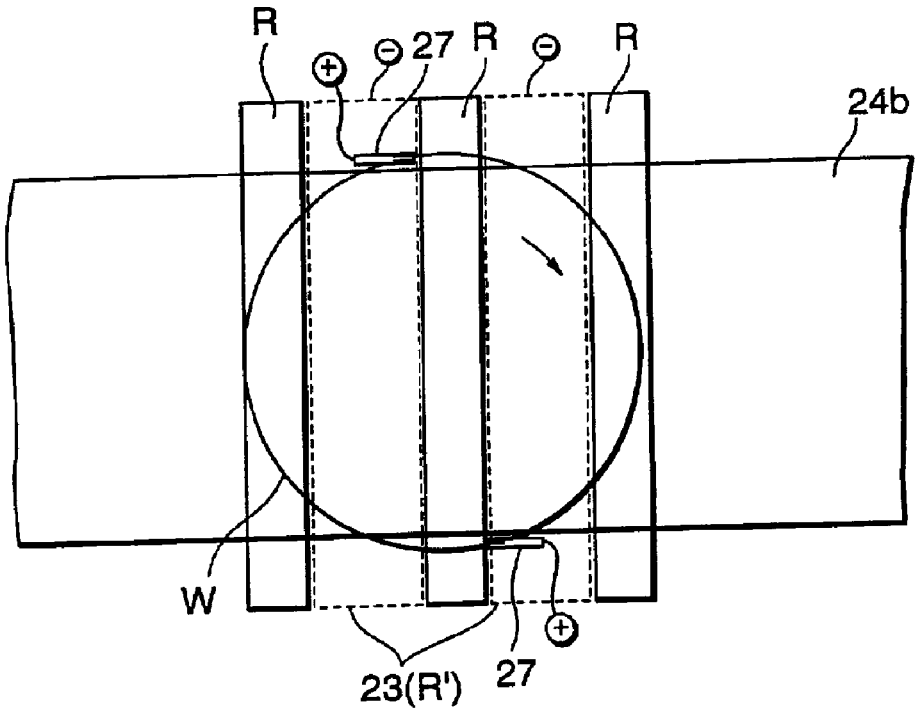
FIG. 33A is a schematic top view illustrating the layout of feature parts of an electro-chemical machining apparatus according to a thirteenth preferred embodiment of the present invention and FIG. 33B is a schematic side cross sectional view corresponding to FIG. 33A.
Figure 33B:
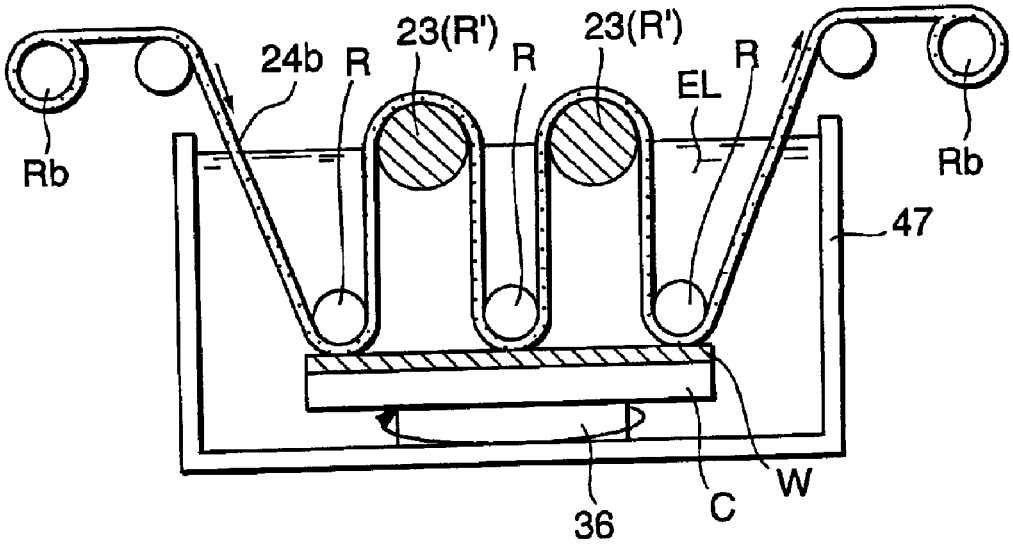
Figure 34:
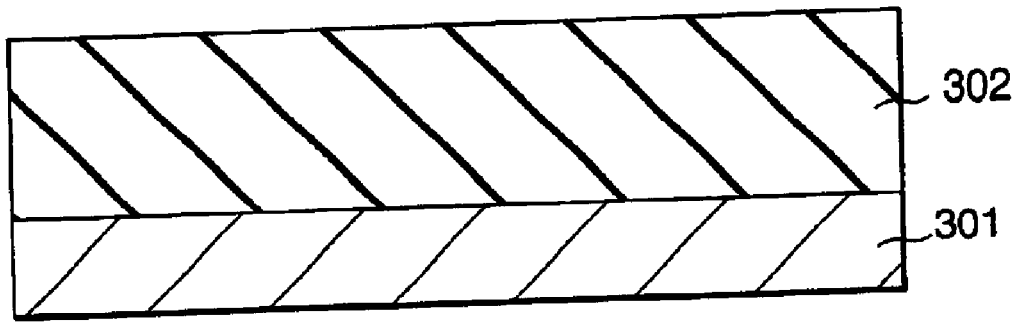
FIG. 34 to FIG. 36 are schematic cross sectional views illustrating sequential steps of forming a copper film by a conventional damascene process.
Figure 35:
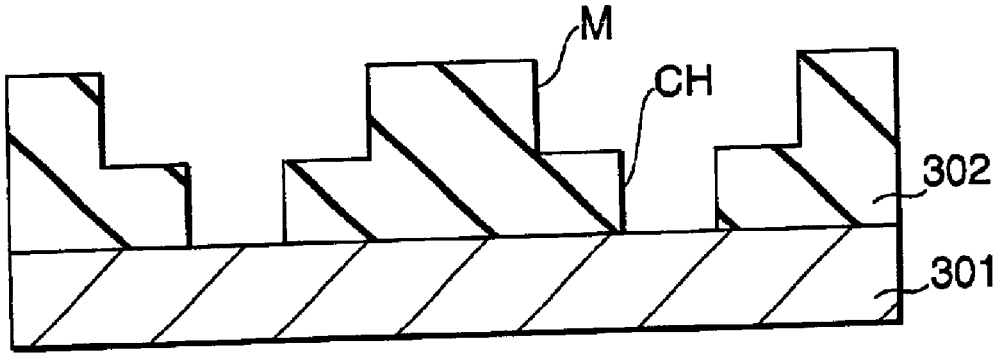
Figure 36:
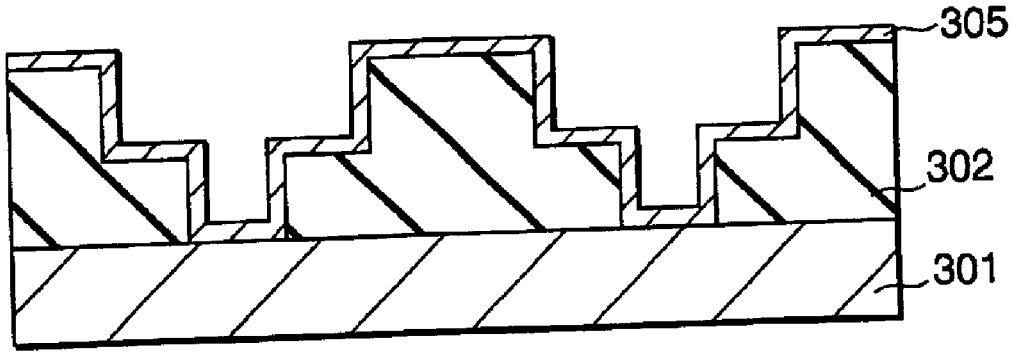
Figure 37:
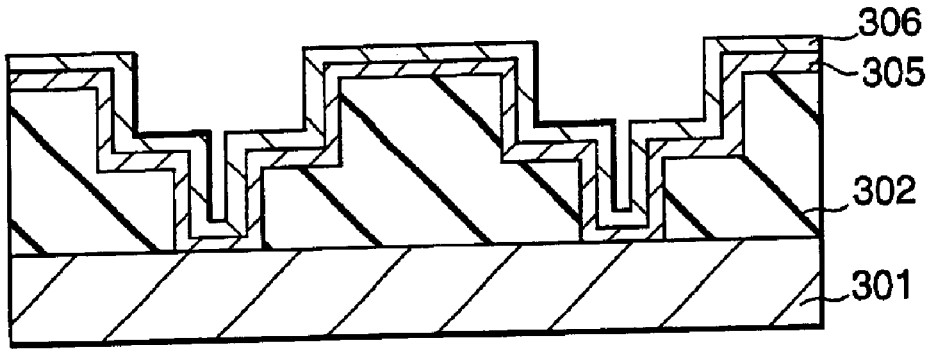
Figure 38:
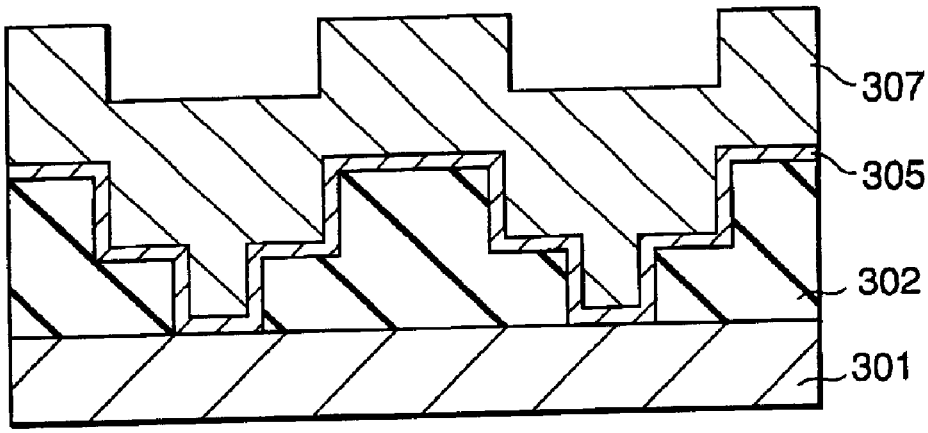
Figure 39:
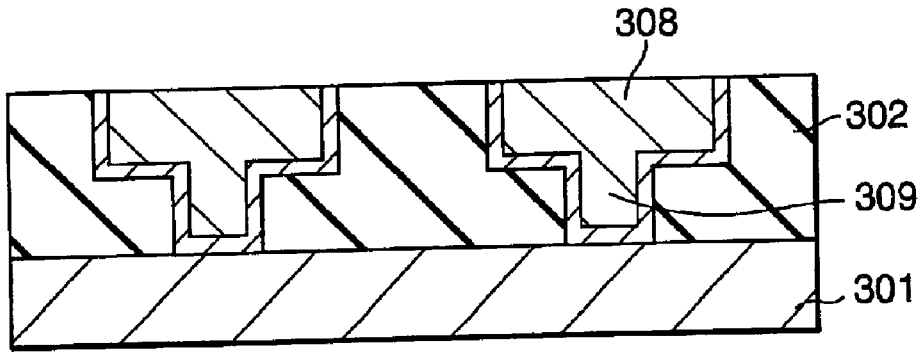
Figure 40:
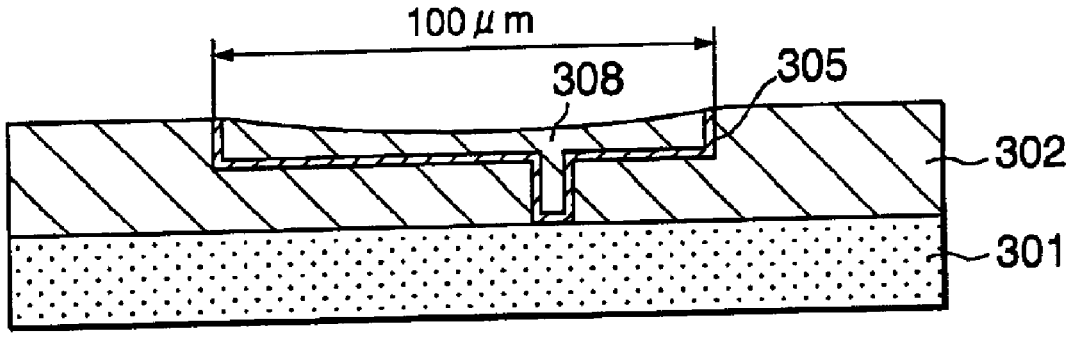
FIG. 40 is a schematic cross sectional view for describing a dishing problem associated with a copper film formed by a conventional CMP technique.
Figure 41:
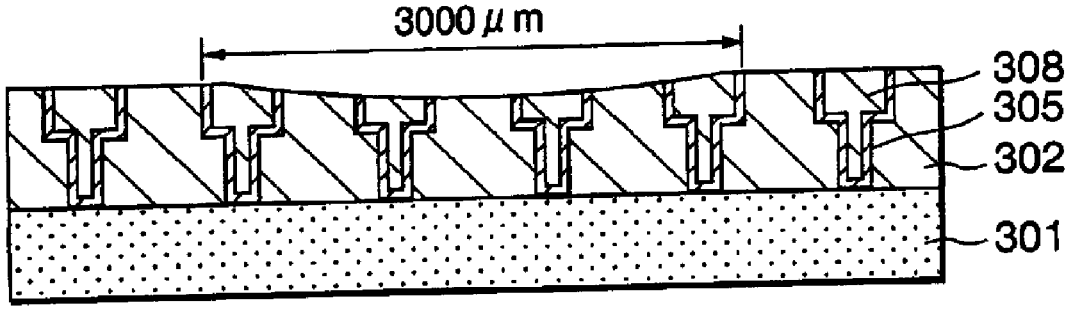
FIG. 41 is a schematic cross sectional view for describing an erosion problem associated with a copper film formed by a conventional CMP technique.
Figure 42:
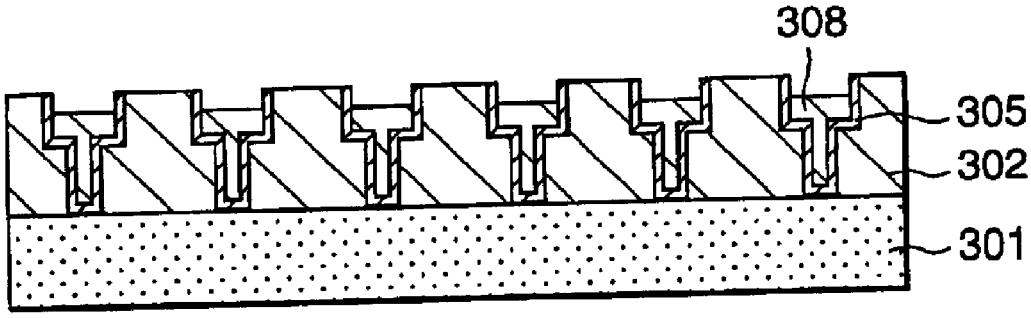
FIG. 42 is a schematic cross sectional view for describing a recess problem associated with a copper layer formed by a conventional CMP technique.
Figure 43:
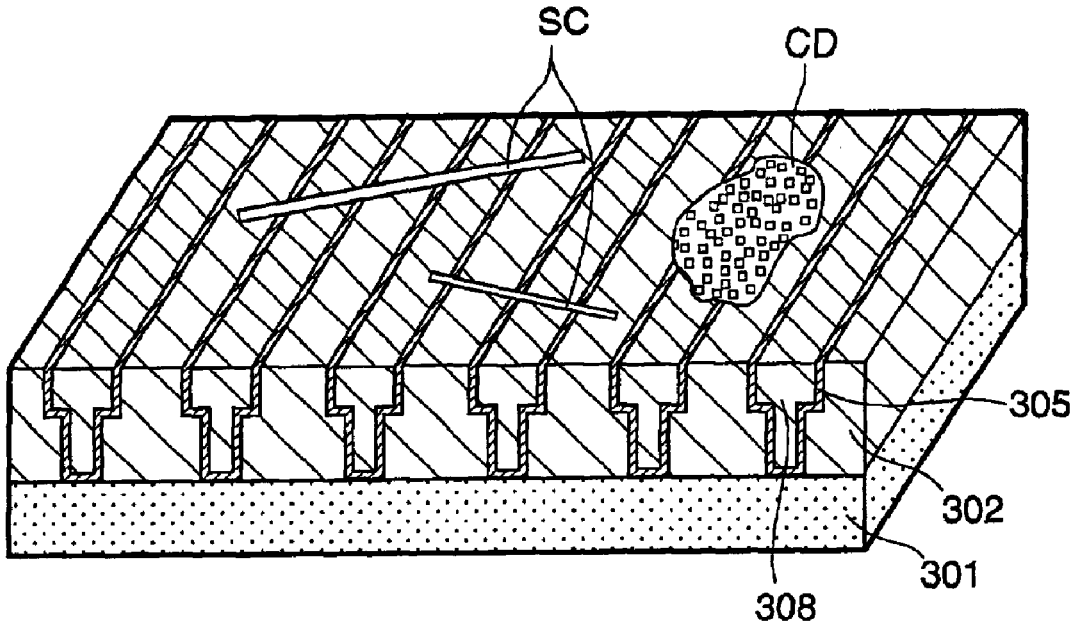
FIG. 43 is a schematic cross sectional view showing scratch and chemical damages in a copper film formed by a conventional CMP technique.

FIG. 33A is a top view of a feature portion of a thirteenth preferred embodiment of the electro-chemical machining apparatus according to the preferred embodiment and illustrates the layout of the wafer, the cathode electrode plate and the wiper. FIG. 33B is a side cross sectional view corresponding to FIG. 33A. The elongate belt-like wiper is similar to the above eleventh and twelfth preferred embodiments.

The wafer W is held by the chuck C of the rotary driven wafer support 36 at the bottom of the electrolytic solution bath 47 storing the electrolytic solution EL with the surface to be machined facing upwardly. The belt-like wiper 24*b* is driven into the electrolytic solution reservoir 47 by 3 rollers R in the electrolytic solution reservoir 47 and two rollers R' near the surface of the solution. Each of the rollers R, R' is made to rotate about the supporting shaft. The belt-like wiper 24*b* engages the surface to be machined of the wafer W by the 3 rollers in the electrolytic solution reservoir and is driven by the rollers to move in one direction for wiping the surface to be machined of the wafer W.

In this preferred embodiment of the electro-chemical machining apparatus, the 2 rollers R' near the surface of the solution also act as the cathode electrode 23. In addition, there are provided, e.g., 2 electrically conductive brushes 27 acting as the anode at the locations not contacting the belt-like wiper 24*b*. For performing electro-chemical machining, a predetermined voltage is applied between the surface to be machined and the rollers R' (or electrode 23) is and the wafer W is driven to rotate while the belt-like wiper 24*b* is transferred in one direction by the rollers R. The belt-like wiper 24*b* is driven out of the roll Ra at the location near the electrolytic solution reservoir 47 and rewound about the roll Rb outside the electrolytic solution reservoir 47. The belt-like wiper 24*b* may be formed in a loop by coupling both ends so as to be used in an endless manner in the electro-chemical machining apparatus.

According to the thirteenth preferred embodiment of the electro-chemical machining apparatus, there is only the electrolytic solution between the surface to be machined and the rollers R' when a predetermined voltage is applied. Advantageously, current efficiency is high because electricity is not supplied through the wiper. Another advantage is non-interference between the belt-like wiper and the electrode.

In addition, positional changes of the rollers R' (electrode 23) varies the distance between the surface to be machined of the wafer W and the electrode 23 in the range of, e.g., several mm to tens of mm for adjusting the electrolytic current value to improve quality of the electro-chemical machining.

Also, in similar way to the first preferred embodiment, the electro-chemical machining can be performed efficiently at a low pressure to ease steps on the surface to be machined or smoothing the surface by anode oxidation of the metal film surface to be machined and wiping off the anode oxidized metal film by the wiper.

Although the surface to be machined of the wafer faces upwardly in the thirteenth preferred embodiment of the electro-chemical machining apparatus, it is possible that the surface to be machined of the wafer may face downwardly by modifying the locations of the rollers and the belt-like wiper.

Although 13 preferred embodiments of the present invention are described herein, the present invention should not be limited to these embodiments. For example, the composition of the electrolytic solution is not restricted to those as described above and may contain various other additives such as brighteners and chelating agents other than those mentioned above. Many other modifications, combinations and sub-combinations may be made without departing from the scope and spirit of the present invention.

What is claimed is:

1. An electro-chemical machining apparatus for performing electro-chemical machining on an object to be machined having a metal film on a surface to be machined, said apparatus comprising:

a holding means for holding said object to be machined;

a wiper having a wiping surface for wiping said surface of said object to be machined;

a supplying means for supplying electrolytic solution onto said surface of said object to be machined;

a second electrode disposed adjacent to said wiper and having at least one venting hole disposed therein wherein said hole is configured to vent gas from said surface of said object to be machined; and a power supply for supplying electrical current between said second electrode and a first electrode.

2. The electro-chemical machining apparatus according to claim 1, wherein said metal film is a wiring metal film.

3. The electro-chemical machining apparatus according to claim 2, wherein said wiring metal film comprises at least one element selected from the group consisting of copper, aluminum, tungsten, gold, silver and any alloy, oxide or nitride of said metals.

4. The electro-chemical machining apparatus according to claim 1, wherein said holding means rotates said object to be machined around a rotary axis.

5. The electro-chemical machining apparatus according to claim 4, wherein said holding means applies a pressure onto said object to be machined and rotates said object to be machined around said rotary axis.

6. The electro-chemical machining apparatus according to claim 1, further comprising parallel moving means for moving said holding means in parallel with said wiping surface of said wiper.

7. The electro-chemical machining apparatus according to claim 1, wherein said wiper comprises a resilient material.

8. The electro-chemical machining apparatus according to claim 1, wherein said wiper is provided with venting holes.

9. The electro-chemical machining apparatus according to claim 1, further comprising a wiper support member for supporting said wiper, wherein said support member is provided with venting holes.

10. The electro-chemical machining apparatus according to claim 1, wherein said wiper is rotatably provided on a rotary axis.

11. The electro-chemical machining apparatus according to claim 1, wherein said means for supplying electrolytic solution supplies electrolytic solution including an electrolyte and an additive.

12. The electro-chemical machining apparatus according to claim 11, wherein said additive contains copper ions.

13. The electro-chemical machining apparatus according to claim 11, wherein said additive contains at least one element selected from the group consisting of a brightener and a chelating agent.

14. The electro-chemical machining apparatus according to claim 11, wherein said electrolytic solution contains polishing particles.

15. The electro-chemical machining apparatus according to claim 1, wherein said power supply supplies electrical current by applying a repetitive pulse voltage between said surface to be machined and said first electrode.

16. The electro-chemical machining apparatus according to claim 15, wherein said power supply supplies electrical current by applying a voltage form selected from the group consisting of a rectangular pulse form, a sine wave form, a ramp form, and a PAM form between said surface to be machined and said first electrode.

17. The electro-chemical machining apparatus according to claim 1, wherein said power supply supplies variable voltage to change electrical current flowing between said surface to be machined and said first electrode in at least an initial stage and near a final stage of electro-chemical machining.

18. The electro-chemical machining apparatus according to claim 17, wherein said power supply sets said electrical current between said surface to be machined and said first electrode to be relatively large in said initial stage of electro-chemical machining and to relatively low in said final stage.

19. The electro-chemical machining apparatus according to claim 1, further comprising a temperature adjusting means for adjusting a temperature of said electrolytic solution supplied from said means for supplying electrolytic solution.

20. The electro-chemical machining apparatus according to claim 19, wherein said temperature adjusting means adjust said temperature of said electrolytic solution to 80° C. or lower.

* * * * *